US010689221B2

(12) United States Patent
Sakano et al.

(10) Patent No.: US 10,689,221 B2
(45) Date of Patent: Jun. 23, 2020

(54) SHEET PROCESSING APPARATUS AND IMAGE FORMING SYSTEM

(71) Applicants: Koki Sakano, Kanagawa (JP); Nobuyoshi Suzuki, Tokyo (JP); Hidehiko Fujiwara, Tokyo (JP); Yuusuke Shibasaki, Kanagawa (JP); Wataru Takahashi, Toyko (JP); Katsuhiro Kosuge, Kanagawa (JP); Makoto Hidaka, Tokyo (JP); Shohichi Satoh, Kanagawa (JP); Akira Kunieda, Tokyo (JP); Takuya Morinaga, Tokyo (JP); Yohsuke Haraguchi, Kanagawa (JP)

(72) Inventors: Koki Sakano, Kanagawa (JP); Nobuyoshi Suzuki, Tokyo (JP); Hidehiko Fujiwara, Tokyo (JP); Yuusuke Shibasaki, Kanagawa (JP); Wataru Takahashi, Toyko (JP); Katsuhiro Kosuge, Kanagawa (JP); Makoto Hidaka, Tokyo (JP); Shohichi Satoh, Kanagawa (JP); Akira Kunieda, Tokyo (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 79 days.

(21) Appl. No.: 15/150,499

(22) Filed: May 10, 2016

(65) Prior Publication Data

US 2016/0340144 A1 Nov. 24, 2016

(30) Foreign Application Priority Data

May 22, 2015 (JP) ..... 2015-104324

(51) Int. Cl.
*B65H 37/04* (2006.01)
*G03G 15/00* (2006.01)
*B42B 2/00* (2006.01)

(52) U.S. Cl.
CPC ..... *B65H 37/04* (2013.01); *B42B 2/00* (2013.01); *G03G 15/6541* (2013.01);
(Continued)

(58) Field of Classification Search
CPC ..... B65H 2408/40; B65H 2301/43828; B65H 2301/51611; B65H 2301/51616; G03G 15/6544; B31F 5/02
(Continued)

(56) References Cited

U.S. PATENT DOCUMENTS 5,100,119 A * 3/1992 Komada ..... B25C 5/1689 270/58.14
8,170,446 B2 * 5/2012 Matsui ..... G03G 21/1633 399/112

(Continued)

FOREIGN PATENT DOCUMENTS

JP 11349159 A * 12/1999
JP 2015-016974 1/2015

*Primary Examiner* — Jennifer E Simmons
(74) *Attorney, Agent, or Firm* — Harness, Dickey & Pierce, P.L.C.

(57) ABSTRACT

A sheet processing apparatus includes: a conveying unit configured to convey a sheet along a sheet conveyance path; a conveyance-path supporting unit configured to support both ends of the sheet conveyance path with respect to a direction perpendicular to a sheet conveying direction; a first stitching unit configured to stitch the sheets conveyed; a second stitching unit configured to stitch the sheets conveyed; a first moving unit configured to move the first stitching unit in a direction perpendicular to the sheet conveying direction; and a second moving unit configured to move the second stitching unit in a direction perpendicular
(Continued)

to the sheet conveying direction, wherein any one of the first stitching unit and the second stitching unit is movable to outside of the conveyance-path supporting unit.

9 Claims, 25 Drawing Sheets

(52) U.S. Cl.
CPC ..... *G03G 15/6582* (2013.01); *B65H 2301/51611* (2013.01); *B65H 2301/51616* (2013.01); *B65H 2408/1222* (2013.01); *B65H 2801/27* (2013.01); *G03G 2215/00831* (2013.01)

(58) Field of Classification Search
USPC ..... 399/114, 124
See application file for complete search history.

(56) References Cited

U.S. PATENT DOCUMENTS 8,246,033 B2 * 8/2012 Sato ..... B42C 1/12 270/58.07
2007/0045923 A1 * 3/2007 Moriyama ..... B65H 35/008 270/58.1
2010/0226683 A1 * 9/2010 Yamaguchi ..... G03G 21/1633 399/110
2013/0300050 A1 * 11/2013 Suzuki ..... B65H 39/00 270/58.07
2015/0003938 A1 1/2015 Morinaga et al.
2015/0014386 A1 * 1/2015 Obuchi ..... G03G 21/1633 227/100
2015/0030414 A1 1/2015 Takahashi et al.
2015/0076759 A1 3/2015 Kosuge et al.
2015/0093214 A1 4/2015 Takahashi et al.
2015/0165809 A1 * 6/2015 Komiyama ..... B42B 5/08 412/38
2016/0185149 A1 * 6/2016 Kenjo ..... B65H 37/04 412/33

* cited by examiner (a)

(b)

(a)

(b)

SHEET PROCESSING APPARATUS AND IMAGE FORMING SYSTEM

CROSS-REFERENCE TO RELATED APPLICATION

The present application claims priority under 35 U.S.C. § 119 to Japanese Patent Application No. 2015-104324, filed May 22, 2015. The contents of which are incorporated herein by reference in their entirety.

BACKGROUND OF THE INVENTION

1. Field of the Invention

The present invention relates to a sheet processing apparatus and an image forming system.

2. Description of the Related Art

In recent years, there have been known sheet processing apparatuses that are connected to an image forming apparatus while in use and that collectively stitch multiple sheets, which have been output from the image forming apparatus and on which images have been formed. Among these sheet processing apparatuses, there are disclosed and already-known sheet processing apparatuses that include both a staple-containing stitching unit, which performs a stitching operation by using staples, and a staple-free stitching unit that performs a stitching operation without using any staples.

However, the above-described sheet processing apparatus has a problem in that it is difficult to perform an operation to supply staples to the staple-containing stitching unit due to the interference with the staple-free stitching unit. Therefore, among the above-described sheet processing apparatuses, there is a disclosed and already-known sheet processing apparatus that is configured such that the staple-containing stitching unit is located on the front side of the apparatus and the staple-free stitching unit is located on the back side of the apparatus and the front side of the apparatus is opened (for example, see Japanese Unexamined Patent Application Publication No. 2015-016974).

However, if the staple-free stitching unit is located on the back side of the apparatus, when the need comes to access the staple-free stitching unit during repair or maintenance of the staple-free stitching unit, or the like, there is a problem in that it is difficult for a user to access the staple-free stitching unit.

SUMMARY OF THE INVENTION

According to one aspect of the present invention, there is provided a sheet processing apparatus including: a conveying unit configured to convey a sheet along a sheet conveyance path; a conveyance-path supporting unit configured to support both ends of the sheet conveyance path with respect to a direction perpendicular to a sheet conveying direction; a first stitching unit configured to stitch the sheets conveyed; a second stitching unit configured to stitch the sheets conveyed; a first moving unit configured to move the first stitching unit in a direction perpendicular to the sheet conveying direction; and a second moving unit configured to move the second stitching unit in a direction perpendicular to the sheet conveying direction, wherein any one of the first stitching unit and the second stitching unit is movable to outside of the conveyance-path supporting unit.

According to another aspect of the present invention, there is provided an image forming system including: an image forming apparatus configured to form an image on a sheet; and a sheet processing apparatus configured to stitch a bundle of sheets, on which an image is formed by the image forming apparatus, the sheet processing apparatus including: a conveying unit configured to convey a sheet along a sheet conveyance path; a conveyance-path supporting unit configured to support both ends of the sheet conveyance path with respect to a direction perpendicular to a sheet conveying direction; a first stitching unit configured to stitch the sheets conveyed; a second stitching unit configured to stitch the sheets conveyed; a first moving unit configured to move the first stitching unit in a direction perpendicular to the sheet conveying direction; and a second moving unit configured to move the second stitching unit in a direction perpendicular to the sheet conveying direction, wherein any one of the first stitching unit and the second stitching unit is movable to outside of the conveyance-path supporting unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DETAILED DESCRIPTION OF THE PREFERRED EMBODIMENTS

Figure 1:
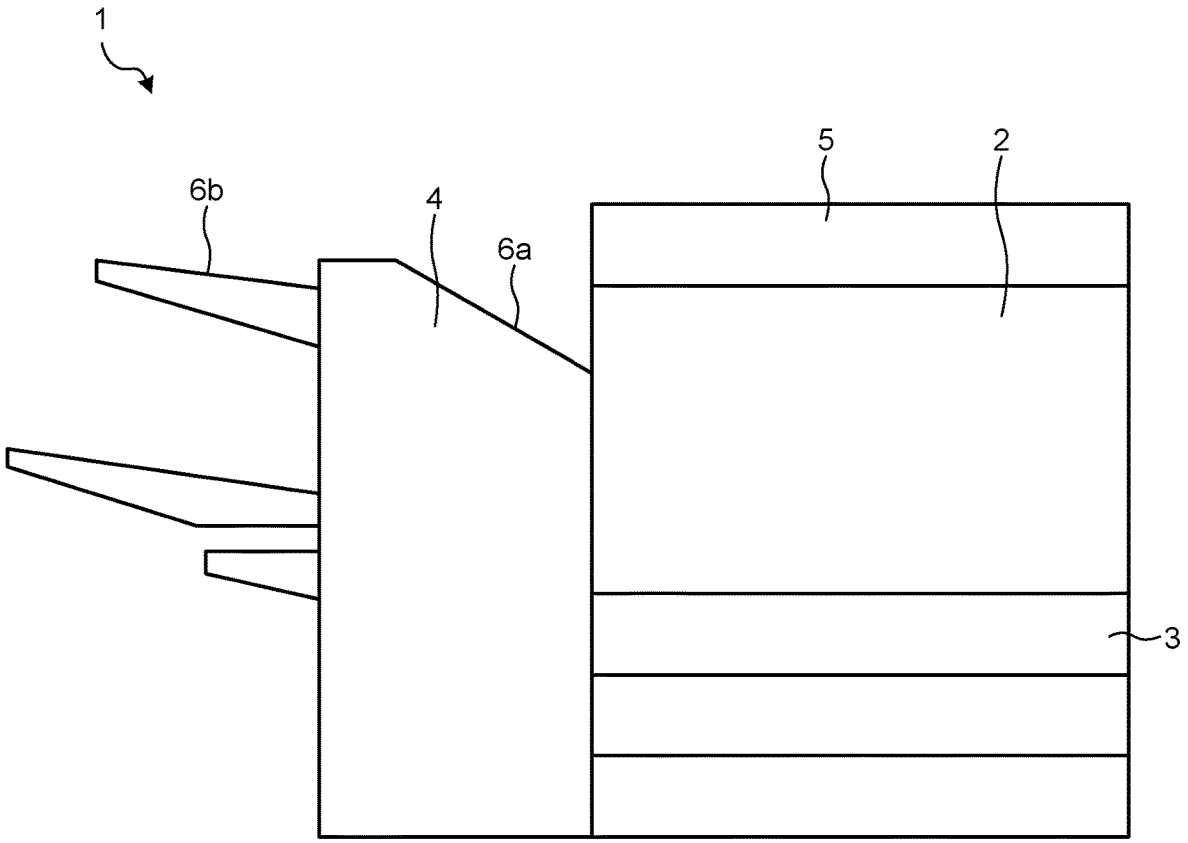
FIG. 1 is a diagram that illustrates a simplified overall configuration of an image forming apparatus according to an embodiment of the present invention.

The terminology used herein is for the purpose of describing particular embodiments only and is not intended to be limiting of the present invention. As used herein, the singular forms "a", an and the are intended to include the plural forms as well, unless the context clearly indicates otherwise. In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result. An embodiment of the present invention will be described in detail below with reference to the drawings.

The present invention has an object to facilitate, in a sheet processing apparatus that includes multiple stitching units, user's access to the stitching units.

First Embodiment

With reference to the drawings, a detailed explanation is given below of an embodiment of the present invention. First, the overall configuration of an image forming system 1 according to the present embodiment is explained with reference to FIG. 1. FIG. 1 is a diagram that illustrates the simplified overall configuration of the image forming system 1 according to the present embodiment. As illustrated in FIG. 1, the image forming system 1 according to the present embodiment includes an image forming apparatus 2, a sheet feeding apparatus 3, a stitching processing apparatus 4, and a document reading device 5.

The image forming apparatus 2 generates the drawing information on CMYK (cyan magenta yellow key plate) on the basis of input image data, and it uses the generated drawing information to conduct image formation output on a sheet that is fed from the sheet feeding apparatus 3.

A specific form of the image forming mechanism of the image forming apparatus 2 according to the present embodiment is an electrophotographic system or an inkjet system. After an image is formed on a sheet by the image forming apparatus 2, it is conveyed to the stitching processing apparatus 4 or is discharged into a discharge tray 6*a* so that it is sequentially stacked. The sheet feeding apparatus 3 feeds a sheet to the image forming apparatus 2.

The stitching processing apparatus 4 performs a stitching operation to collectively stitch multiple sheets, which have been conveyed from the image forming apparatus 2 and on which the images have been formed. Furthermore, the stitching processing apparatus 4 according to the present embodiment includes a staple-containing stitching unit, which performs a stitching operation by using a method (hereafter, referred to as "staple-containing stitching") that uses metallic staples, and includes a staple-free stitching unit, which performs a stitching operation by using a method (hereafter, referred to as "staple-free stitching") that does not use metallic staples. That is, according to the present embodiment, the stitching processing apparatus 4 serves as a sheet processing apparatus. After the bundle of sheets is stitched by the stitching processing apparatus 4, it is discharged into a discharge tray 6*b* so that it is sequentially stacked.

The document reading device 5 reads a document by using a linear image sensor, in which multiple photo diodes are arranged in a column and, in parallel to them, light receiving elements, such as charge-coupled device (CCD) or complementary metal-oxide semiconductor (CMOS) image sensors, are arranged, thereby computerizing the document. Furthermore, the document reading device 5 may include an automatic document feeder to automatically convey a document, which is the target to be read, so that it reads the document that is automatically conveyed from the automatic document feeder.

Furthermore, the image forming system 1 according to the present embodiment has an image capturing function, an image forming function, a communication function, or the like, whereby it is a multifunction peripheral (MFP) that may be used as a printer, facsimile, scanner, or copier.

Figure 2:
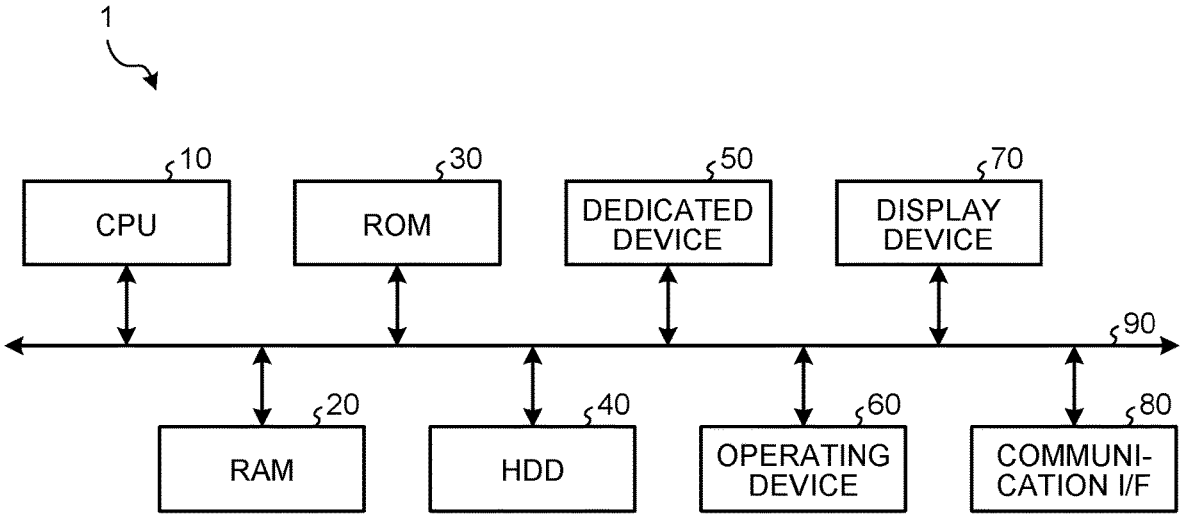
FIG. 2 is a block diagram that schematically illustrates a hardware configuration of the image forming apparatus according to the embodiment of the present invention.

Next, with reference to FIG. 2, an explanation is given of a hardware configuration of the image forming system 1 according to the present embodiment. FIG. 2 is a block diagram that schematically illustrates a hardware configuration of the image forming system 1 according to the present embodiment.

As illustrated in FIG. 2, the image forming system 1 according to the present embodiment includes a central processing unit (CPU) 10, a random access memory (RAM) 20, a read only memory (ROM) 30, a hard disk drive (HDD) 40, a dedicated device 50, an operating device 60, a display device 70, and a communication I/F 80, connected via a bus 90.

The CPU 10 is a calculating unit, and it controls the overall operation of the image forming system 1. The RAM 20 is a volatile storage medium that is capable of reading and writing information at high speed, and it is used as a working area when the CPU 10 processes information. The ROM 30 is a read-only non-volatile storage medium, and it stores programs, such as firmware.

The HDD 40 is a non-volatile storage medium that is capable of reading and writing information, and it stores various types of data, such as image data, and various programs, such as the operating system (OS), various control programs, or application programs.

The dedicated device 50 is the hardware for implementing a dedicated function in the image forming system 1. Specifically, the dedicated device 50 is the hardware for implementing a dedicated function in the printer, facsimile, scanner, copier, or stitching processing mechanism.

The operating device 60 is a user interface for inputting information to the image forming system 1, and it is implemented by an input device, such as a keyboard, mouse, input button, or touch panel.

The display device 70 is a visual user interface for checking the state of the image forming system 1 by a user, and it is implemented by a display device, such as a liquid crystal display (LCD), or an output device, such as a light emitting diode (LED).

The communication I/F 80 is an interface with which the image forming system 1 communicates with a different device, and an interface, such as Ethernet (registered trademark), universal serial bus (USB), Bluetooth (registered trademark), Wireless Fidelity (Wi-Fi) (registered trademark), FeliCa (registered trademark), Peripheral Component Interconnect Express (PCIe), the Institute of Electrical and Electronics Engineers (IEEE) standard, is used.

With the above-described hardware configuration, a program, stored in a storage medium, such as the ROM 30 or the HDD 40, is read into the RAM 20, and the CPU 10 performs calculations in accordance with the program that is loaded into the RAM 20, whereby a software control unit is configured. The combination of the hardware and the software control unit, which is configured as described above, constitute the functional block that implements the function of the image forming system 1 according to the present embodiment.

Figure 3:
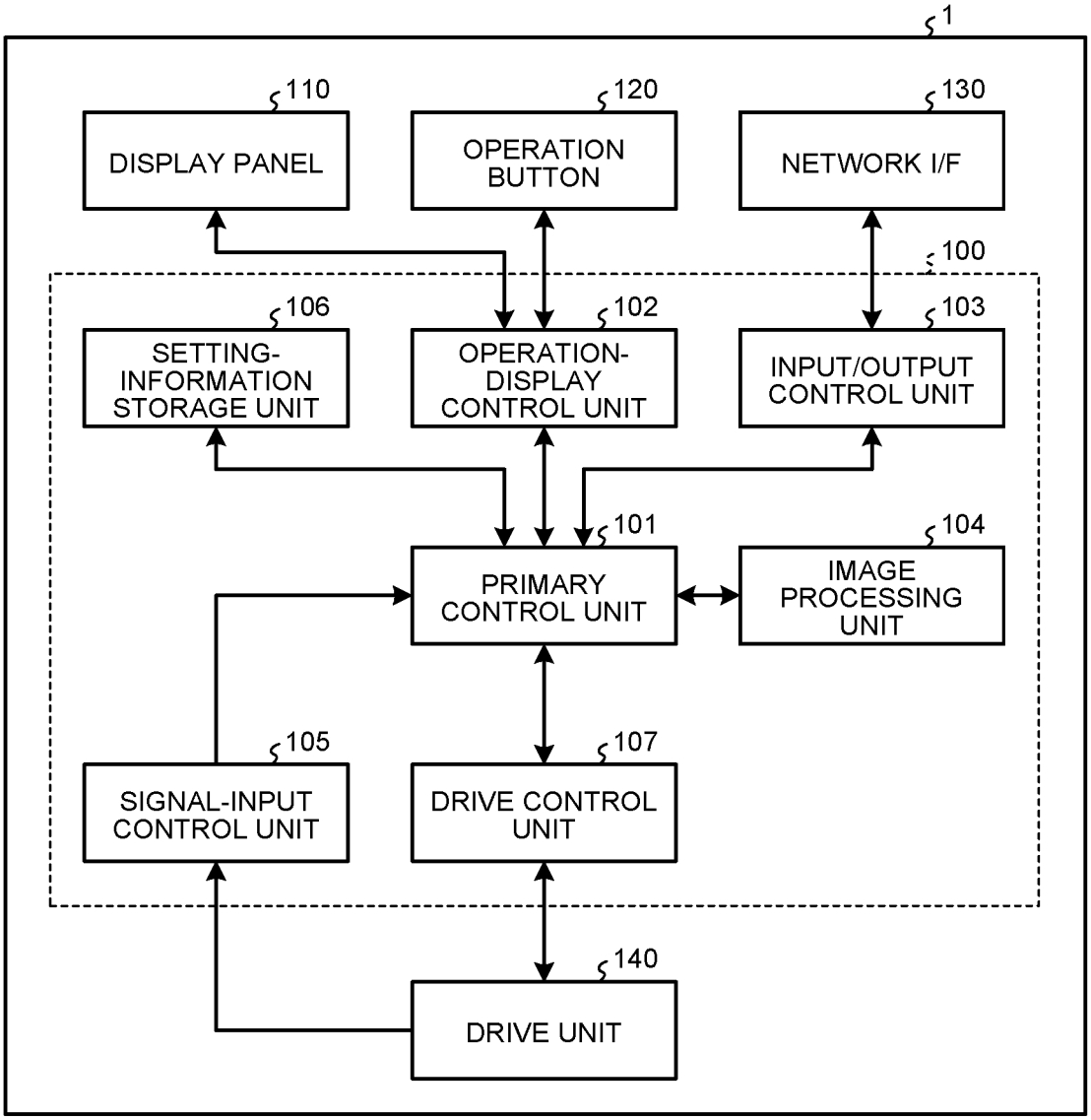
FIG. 3 is a block diagram that schematically illustrates the functional configuration of the image forming apparatus according to the embodiment of the present invention.

Next, with reference to FIG. 3, an explanation is given of the functional configuration of the image forming system 1 according to the present embodiment. FIG. 3 is a block diagram that schematically illustrates the functional configuration of the image forming system 1 according to the present embodiment.

As illustrated in FIG. 3, the image forming system 1 according to the present embodiment includes a controller 100, a display panel 110, an operation button 120, a network I/F 130, and a drive unit 140. Furthermore, the controller 100 includes a primary control unit 101, an operation-display control unit 102, an input/output control unit 103, an image processing unit 104, a signal-input control unit 105, a setting-information storage unit 106, and a drive control unit 107.

The display panel 110 is an output interface that visually displays the state of the image forming system 1, and it is also an input interface as a touch panel when a user directly operates the image forming system 1 or inputs information to the image forming system 1. That is, the display panel 110 has the function to display an image for receiving a user's operation. The display panel 110 is implemented by the operating device 60 and the display device 70, illustrated in FIG. 2.

The operation button 120 is an input interface when a user directly operates the image forming system 1 or inputs information to the image forming system 1. The operation button 120 is implemented by the operating device 60, illustrated in FIG. 2.

A user operates the display panel 110 or the operation button 120 so as to input setting information, such as sheet information.

The network I/F 130 is an interface for communicating with an information processing apparatus such as a personal computer (PC) that is operated by a user. The network I/F 130 is implemented by the communication I/F 80, illustrated in FIG. 2. Various types of information, such as setting information, e.g., sheet information, image data, or print jobs, are transmitted from the above-described information processing apparatus to the image forming system 1 via the network I/F 130.

The drive unit 140 is a drive unit, such as a motor or sensor that is operated in the image forming apparatus 2, the sheet feeding apparatus 3, the stitching processing apparatus 4, or the document reading device 5.

The controller 100 is configured by using the combination of the software and the hardware. Specifically, the controller 100 is configured by using the hardware, such as an integrated circuit, and the software control unit, which is configured when the CPU 10 loads the program, stored in a storage medium, such as the ROM 30 or the HDD 40, into the RAM 20 and performs calculations in accordance with the program.

The primary control unit 101 has a function to control each unit that is included in the controller 100, and it gives a command to each unit of the controller 100.

The operation-display control unit 102 conducts information display on the display panel 110 or notifies the primary control unit 101 of the information that is input via the display panel 110. Furthermore, the primary control unit 101 causes the setting-information storage unit 106 to store the information, notified from the operation-display control unit 102, or gives a command to each unit of the controller 100 in accordance with the information that is notified from the operation-display control unit 102.

The input/output control unit 103 inputs the information, input via the network I/F 130, to the primary control unit 101. Furthermore, the primary control unit 101 causes the setting-information storage unit 106 to store the information, notified from the input/output control unit 103, or gives a command to each unit of the controller 100 in accordance with the information that is input from the input/output control unit 103.

In this way, the primary control unit 101 acquires various types of information, such as setting information, e.g., sheet information, image data, or print jobs, from the operation-display control unit 102 and the input/output control unit 103.

Under the control of the primary control unit 101, the image processing unit 104 generates, as the output information, the drawing information based on the image information that is described in a page description language (PDL), or the like, for example, document data or image data that is included in input print job. The drawing information is information, such as bitmap data in cyan, magenta, yellow, and black (CMYK), and it is the information for drawing the image to be formed by the image forming system 1 during an image formation operation.

Furthermore, the image processing unit 104 processes the captured-image data, input from the document reading device 5, to generate image data. The image data is the information that is stored as the result of a scanner operation in the image forming system 1 or that is transmitted to a different device via the network I/F 130. Furthermore, in the image forming system 1 according to the present embodiment, the drawing information may be directly input instead of the image information so that image formation output is conducted based on the directly input drawing information.

The signal-input control unit 105 inputs, to the primary control unit 101, a detection signal or a measurement signal that is input from each sensor, such as a staple-containing stitching unit detection sensor 422, a staple-free stitching-unit detection sensor 432, or an encoder. Furthermore, the primary control unit 101 inputs a detection signal or a measurement signal, input from the signal-input control unit 105, to the drive control unit 107.

The setting-information storage unit 106 stores setting information, such as sheet information. The drive control unit 107 controls an operation of the drive unit 140. That is, according to the present embodiment, the drive control unit 107 serves as a first moving unit and a second moving unit.

Figure 4:
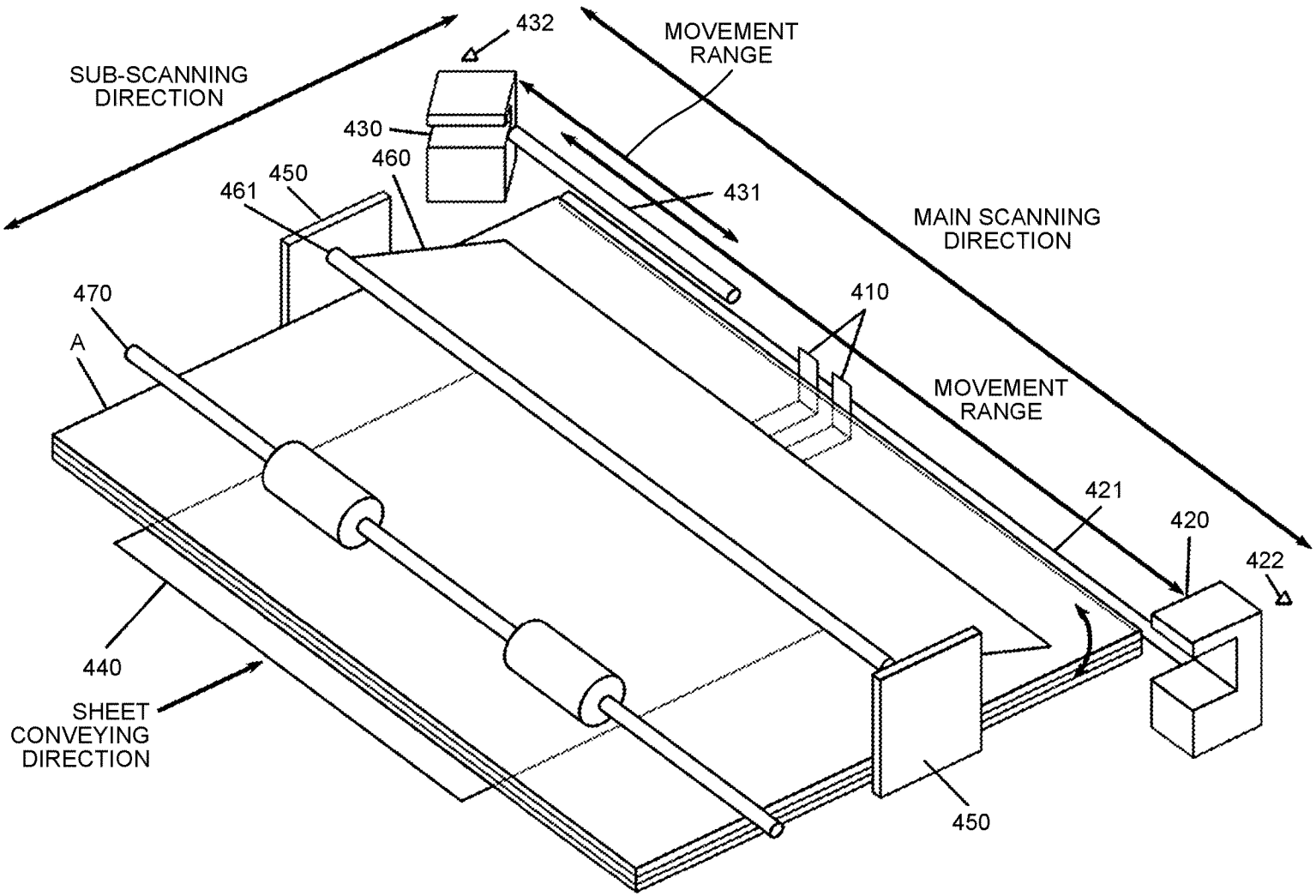
FIG. 4 is a perspective view that illustrates the inside of a stitching processing apparatus according to the embodiment of the present invention.
Figure 5:
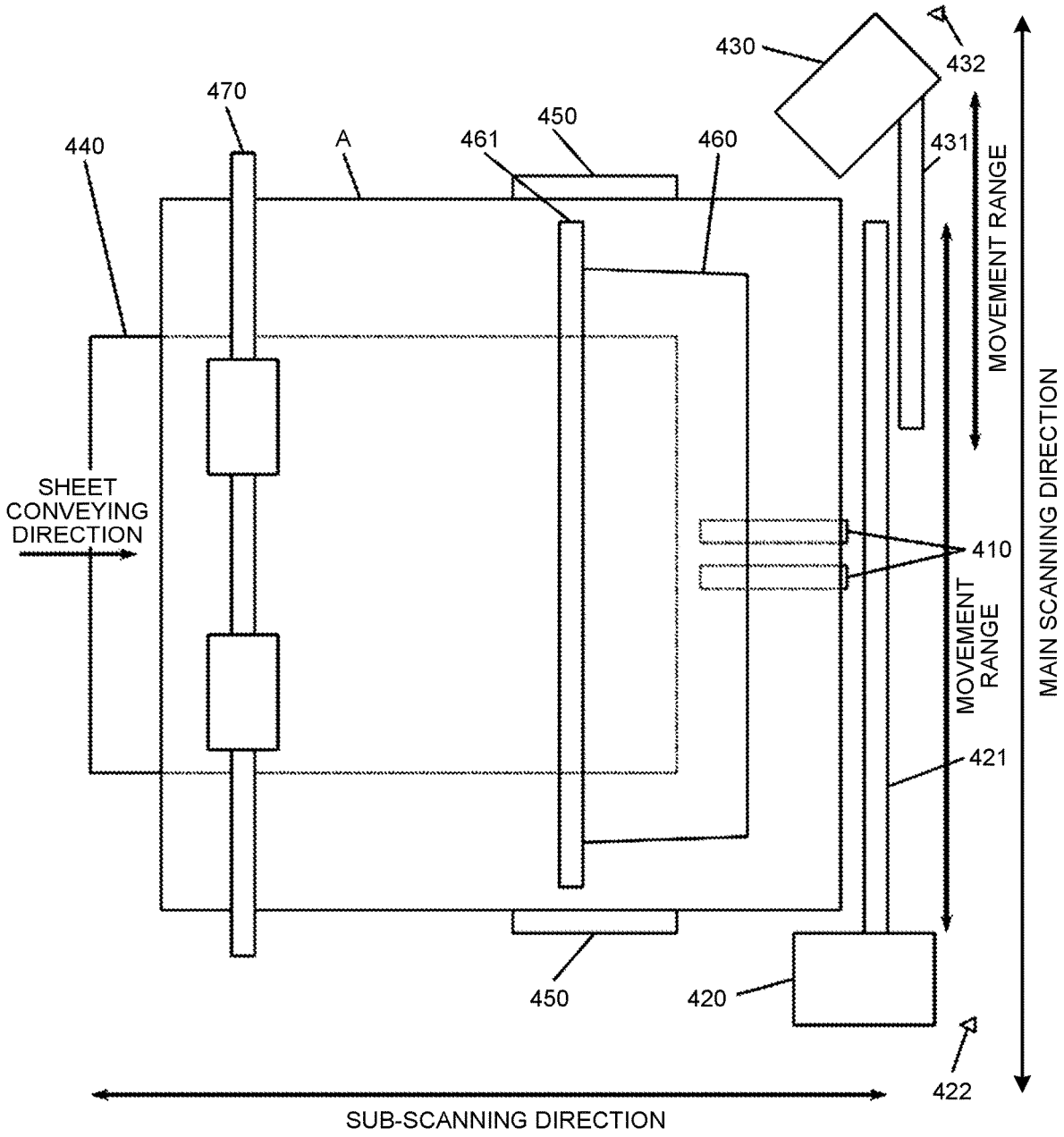
FIG. 5 is a top view that illustrates the inside of the stitching processing apparatus according to the embodiment of the present invention.
Figure 6:
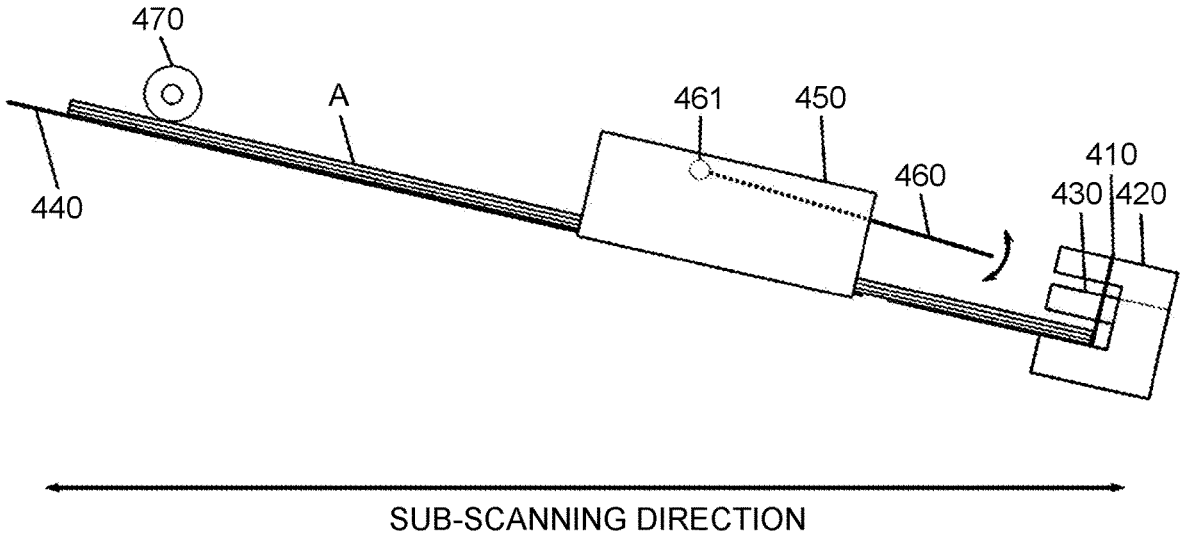
FIG. 6 is a side view that illustrates the inside of the stitching processing apparatus in a main scanning direction according to the embodiment of the present invention.

Next, with reference to FIGS. 4 to 6, an explanation is given of the configuration of the stitching processing apparatus 4 according to the present embodiment. FIG. 4 is a perspective view that illustrates the inside of the stitching processing apparatus 4 according to the present embodiment. FIG. 5 is a top view that illustrates the inside of the stitching processing apparatus 4 according to the present embodiment. FIG. 6 is a side view that illustrates the inside of the stitching processing apparatus 4 in a main scanning direction according to the present embodiment.

As illustrated in FIGS. 4 to 6, the stitching processing apparatus 4 according to the present embodiment includes a trailing-edge alignment stopper 410, a staple-containing stitching unit 420, a staple-containing stitching-unit moving guide rail 421, the staple-containing stitching-unit detection sensor 422, the staple-free stitching unit 430, a staple-free stitching-unit moving guide rail 431, the staple-free stitching-unit detection sensor 432, a sheet stack plate 440, a jogger fence 450, a movable guide plate 460, and a conveyance roller 470. That is, according to the present embodiment, one of the staple-containing stitching unit 420 and the staple-free stitching unit 430 serves as a first stitching unit, and the other one of them serves as a second stitching unit.

The trailing-edge alignment stopper 410 aligns a sheet bundle A in a sheet conveying direction when the edge of the sheet, stacked on the sheet stack plate 440, with regard to the sheet conveying direction comes into contact with it.

Figure 7:
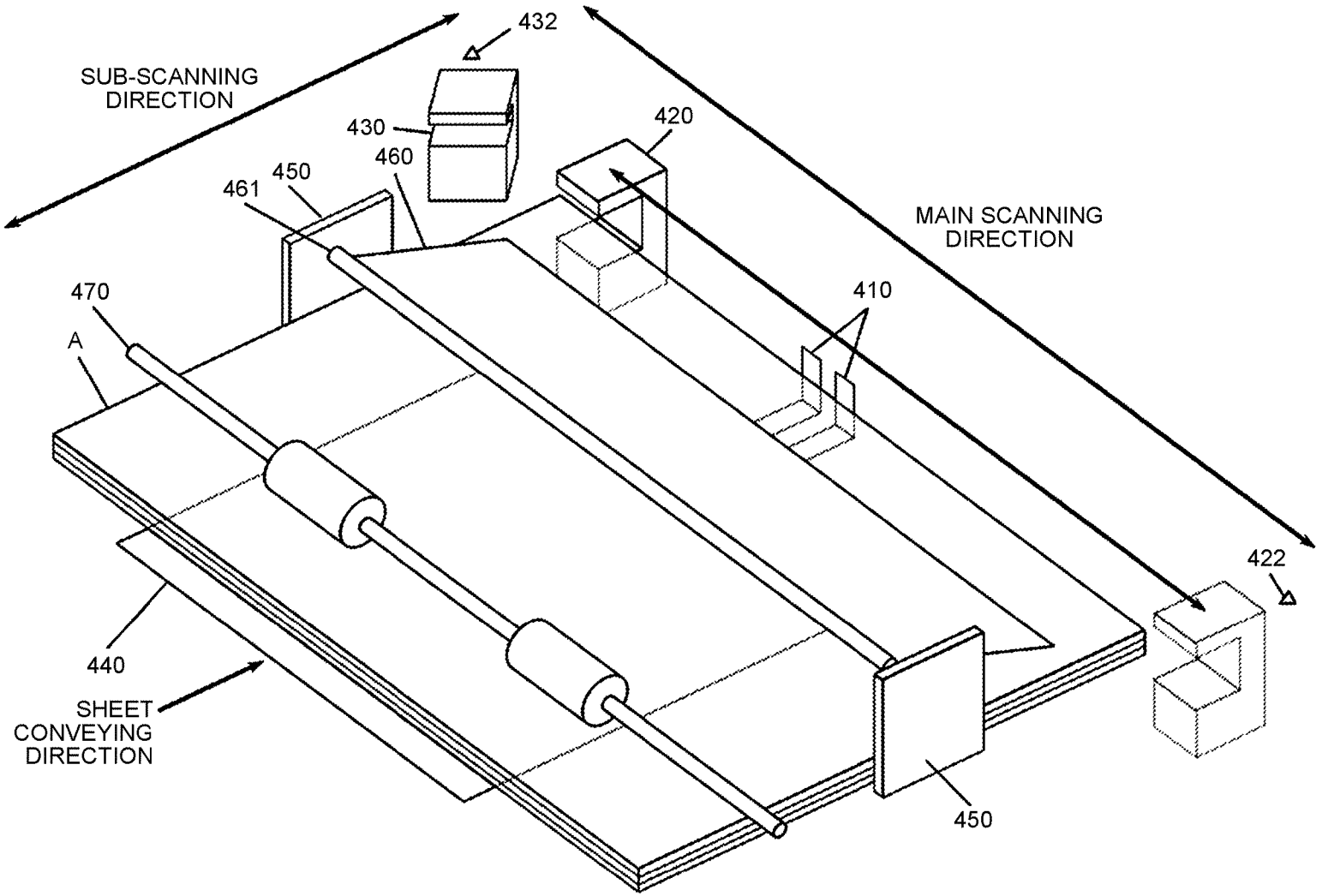
FIG. 7 is a perspective view that illustrates the inside of the stitching processing apparatus according to the embodiment of the present invention.

The staple-containing stitching unit 420 stands by at the home position, which is the reference position, before a stitching operation and, at the stage of the stitching operation, it is moved from the home position to the stitching position along the staple-containing stitching-unit moving guide rail 421, as illustrated in FIG. 7.

Figure 8:
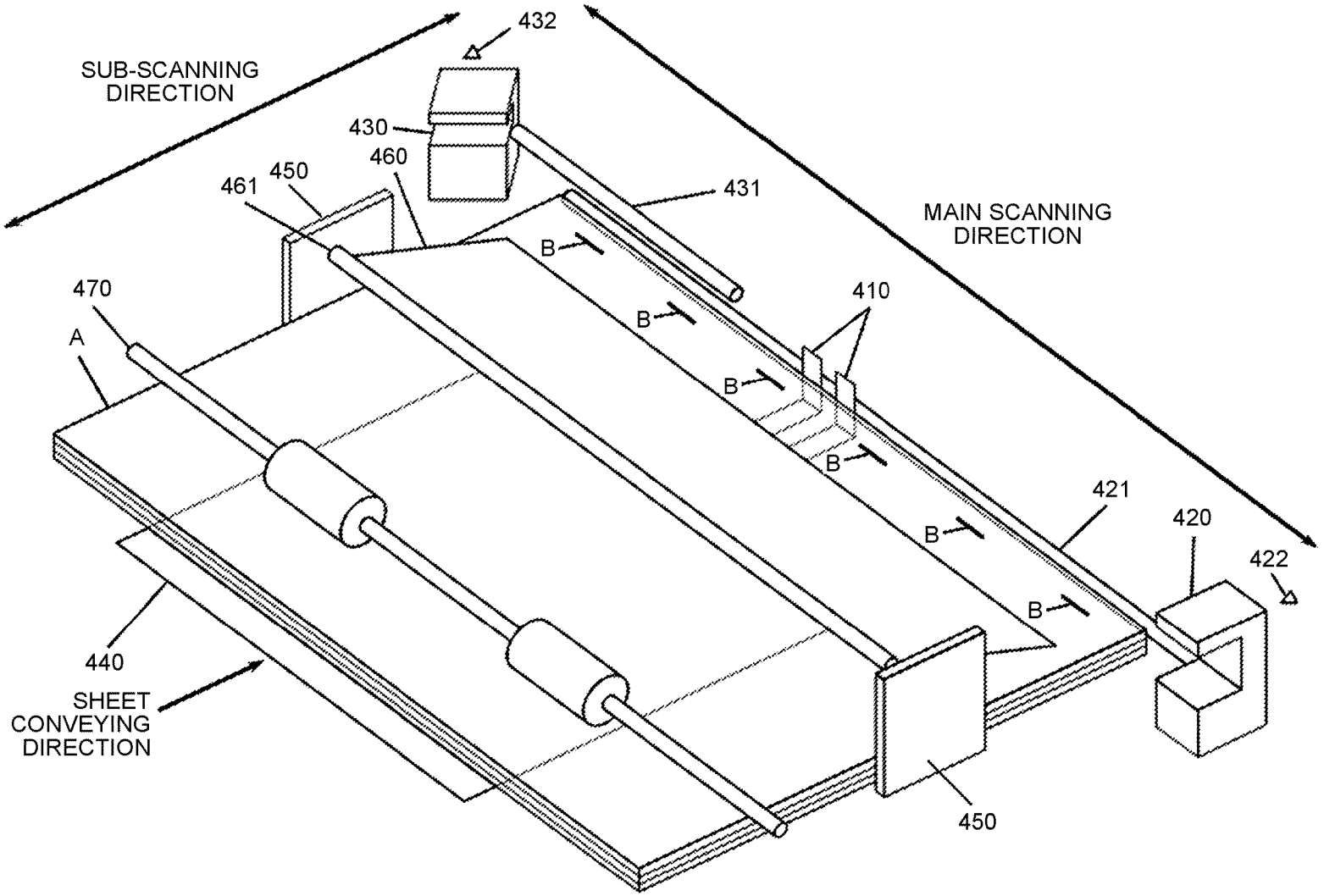
FIG. 8 is a perspective view that illustrates the inside of the stitching processing apparatus according to the embodiment of the present invention.
Figure 9:
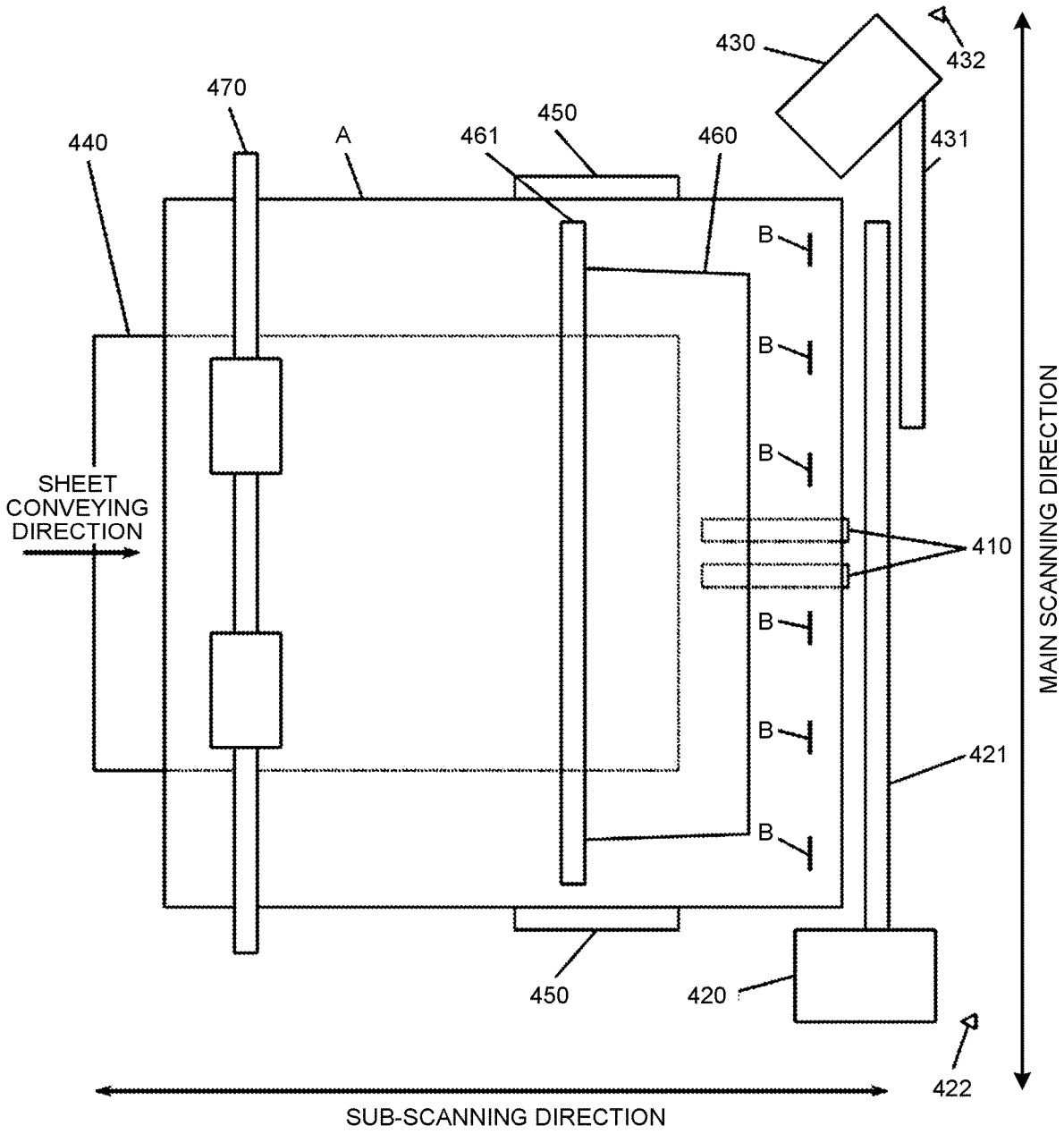
FIG. 9 is a top view that illustrates the inside of the stitching processing apparatus according to the embodiment of the present invention.
Figure 10:
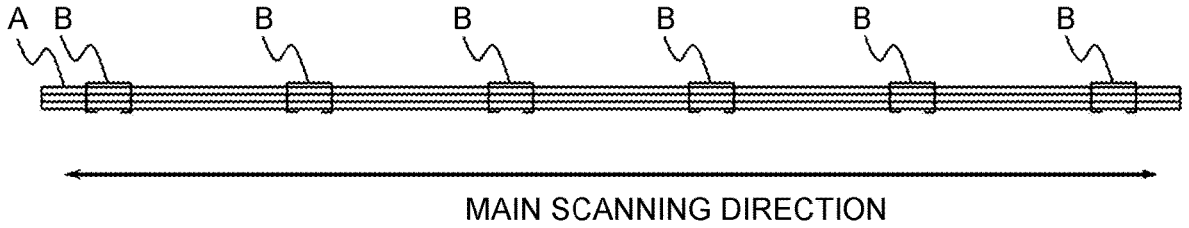
FIG. 10 is a side view of a bundle of sheets, stitched by a staple-containing stitching unit according to the embodiment of the present invention, in a sub-scanning direction.

Then, the staple-containing stitching unit 420 nips the upper and lower sheet surfaces of the sheet bundle A with the stitching recess at multiple stitching positions while it inserts a stitching staple B through the sheet bundle A, thereby stitching the sheet bundle A, as illustrated in FIGS. 8 to 10. That is, according to the present embodiment, the staple-containing stitching unit 420 serves as a staple-containing stitching unit.

Then, after the stitching operation is finished, the staple-containing stitching unit 420 returns to the home position along the staple-containing stitching-unit moving guide rail 421. At this point, in the stitching processing apparatus 4, the staple-containing stitching-unit detection sensor 422 detects that the staple-containing stitching unit 420 stands by at the home position or that the staple-containing stitching unit 420 returns to the home position.

Figure 11:
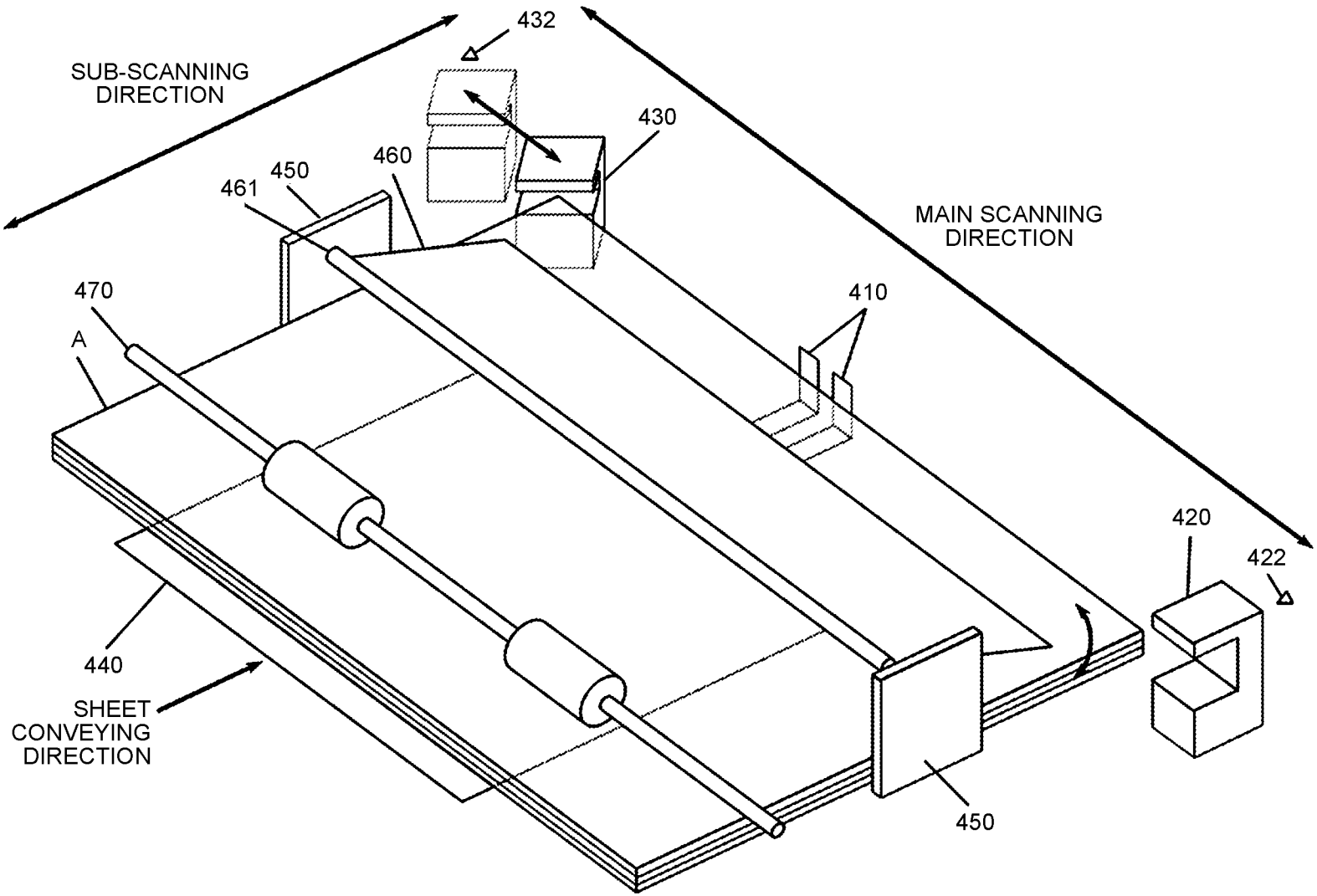
FIG. 11 is a perspective view that illustrates the inside of the stitching processing apparatus according to the embodiment of the present invention.

The staple-free stitching unit 430 stands by at the home position, which is the reference position, before a stitching operation and, at the stage of the stitching operation, it is moved from the home position to the stitching position along the staple-free stitching-unit moving guide rail 431, as illustrated in FIG. 11.

Figure 12:
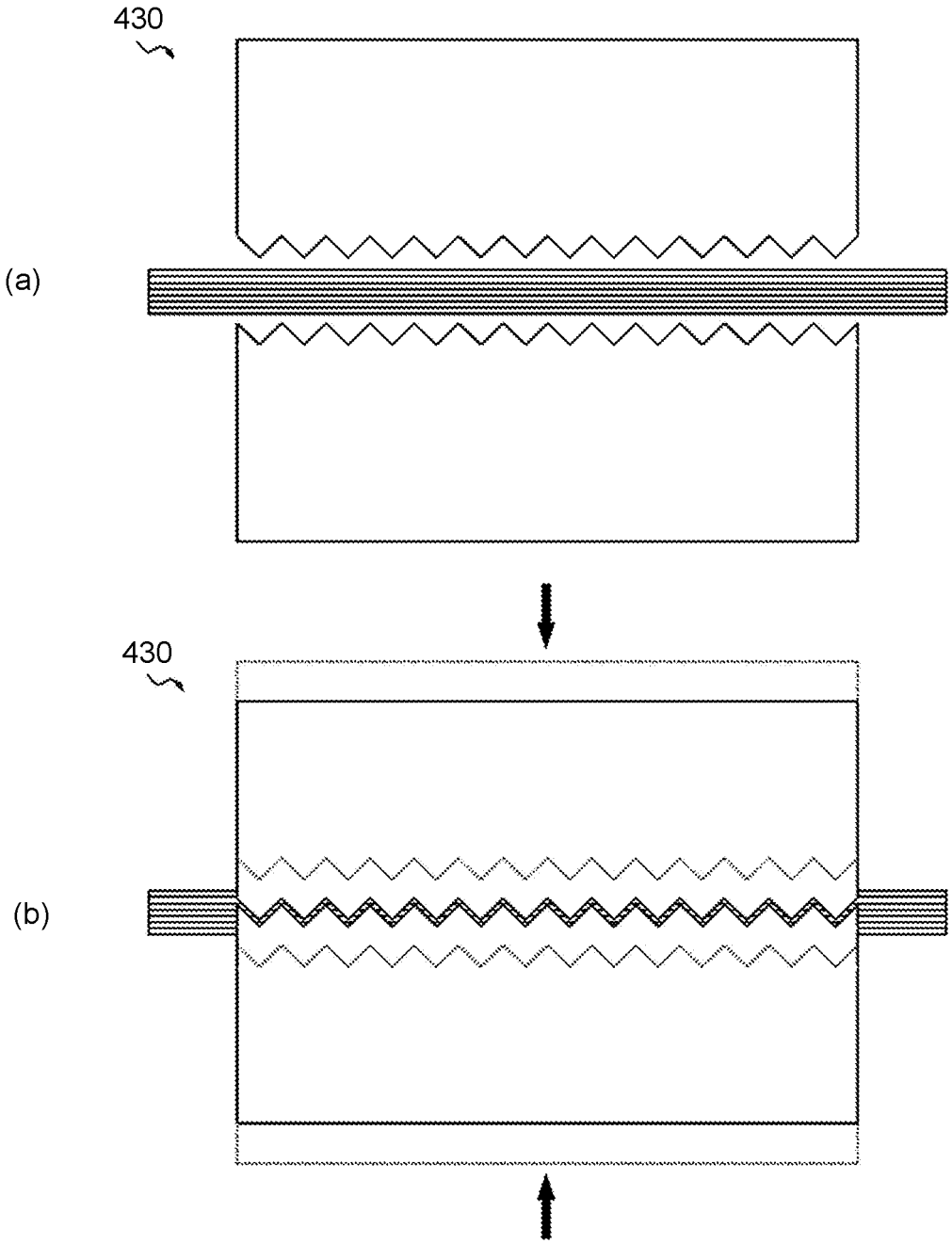
FIG. 12 is a side view of a staple-free stitching unit in a main scanning direction according to the embodiment of the present invention.
Figure 13:
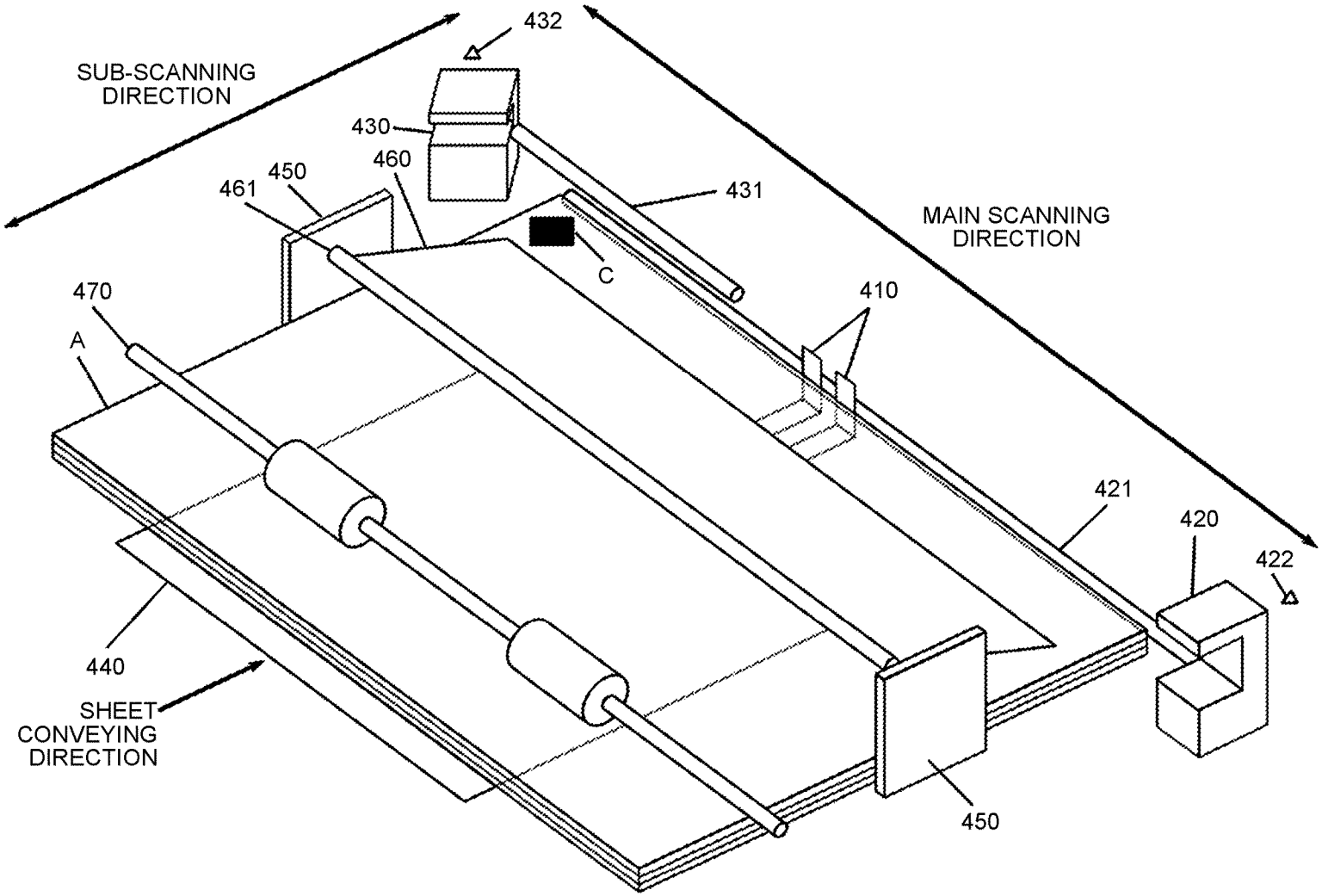
FIG. 13 is a perspective view that illustrates the inside of the stitching processing apparatus according to the embodiment of the present invention.
Figure 14:
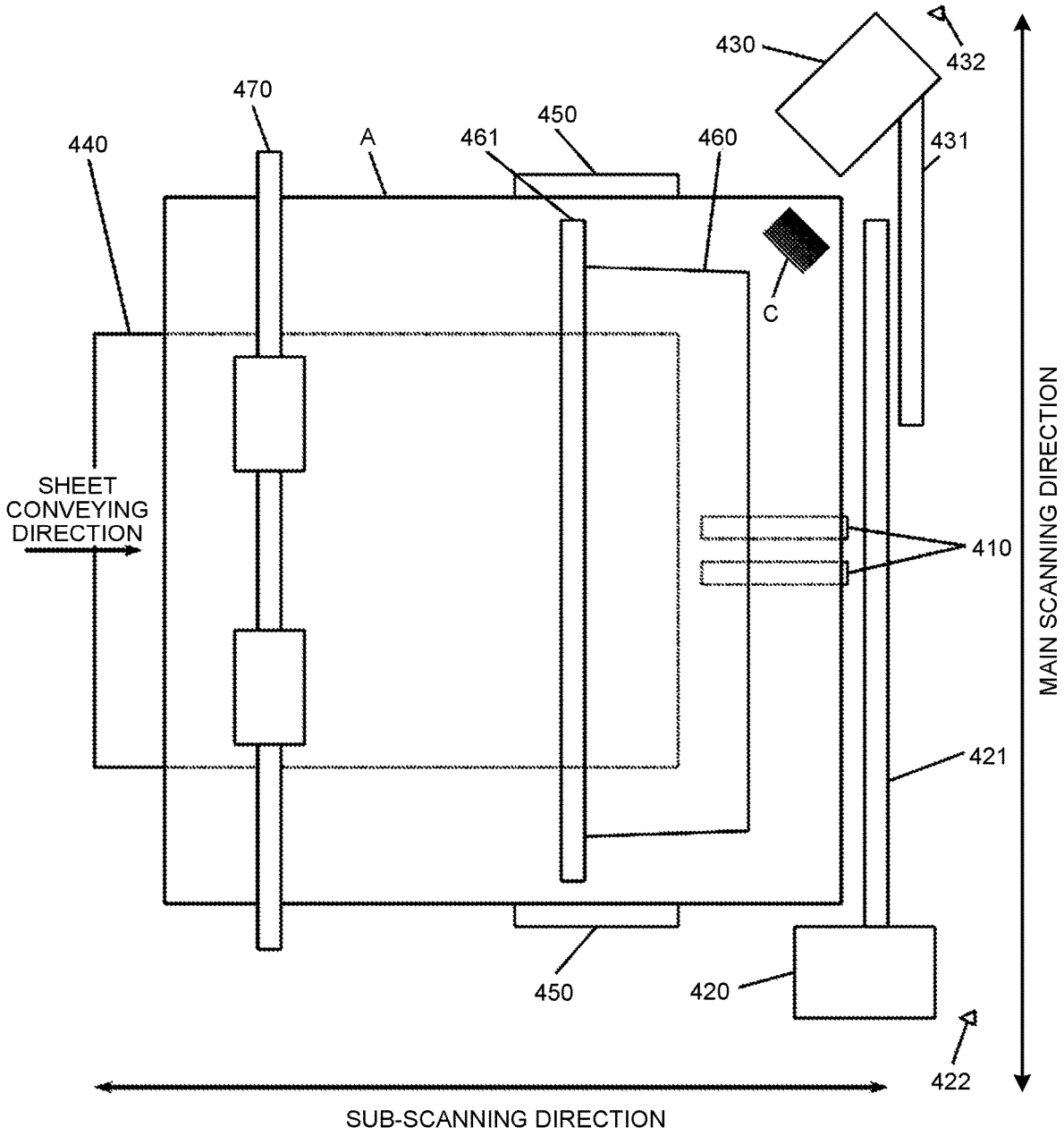
FIG. 14 is a top view that illustrates the inside of the stitching processing apparatus according to the embodiment of the present invention.
Figure 15:
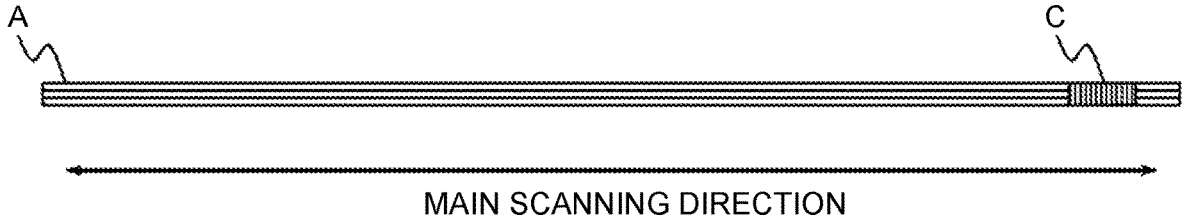
FIG. 15 is a side view of a bundle of sheets, stitched by a staple-free stitching unit according to the embodiment of the present invention, in a sub-scanning direction.

Furthermore, as illustrated in FIGS. 12(*a*) and (*b*), the staple-free stitching unit 430 presses the upper and lower sheet surfaces of the sheet bundle A at the stitching position by using the stitching recess that has the concavity and convexity that are vertically engaged, thereby stitching the sheet bundle A. The fibers of the sheets tangle at a stitching position C so that the sheet bundle A, pressed as described above, is stitched as illustrated in FIGS. 13 to 15. That is, according to the present embodiment, the staple-free stitching unit 430 serves as a staple-free stitching unit.

Then, after the stitching operation is finished, the staple-free stitching unit 430 returns to the home position along the staple-free stitching-unit moving guide rail 431. At this point, in the stitching processing apparatus 4, the staple-free stitching-unit detection sensor 432 detects that the staple-free stitching unit 430 stands by at the home position or that the staple-free stitching unit 430 returns to the home position. That is, according to the present embodiment, the staple-free stitching-unit detection sensor 432 serves as a detecting unit.

Figure 16:
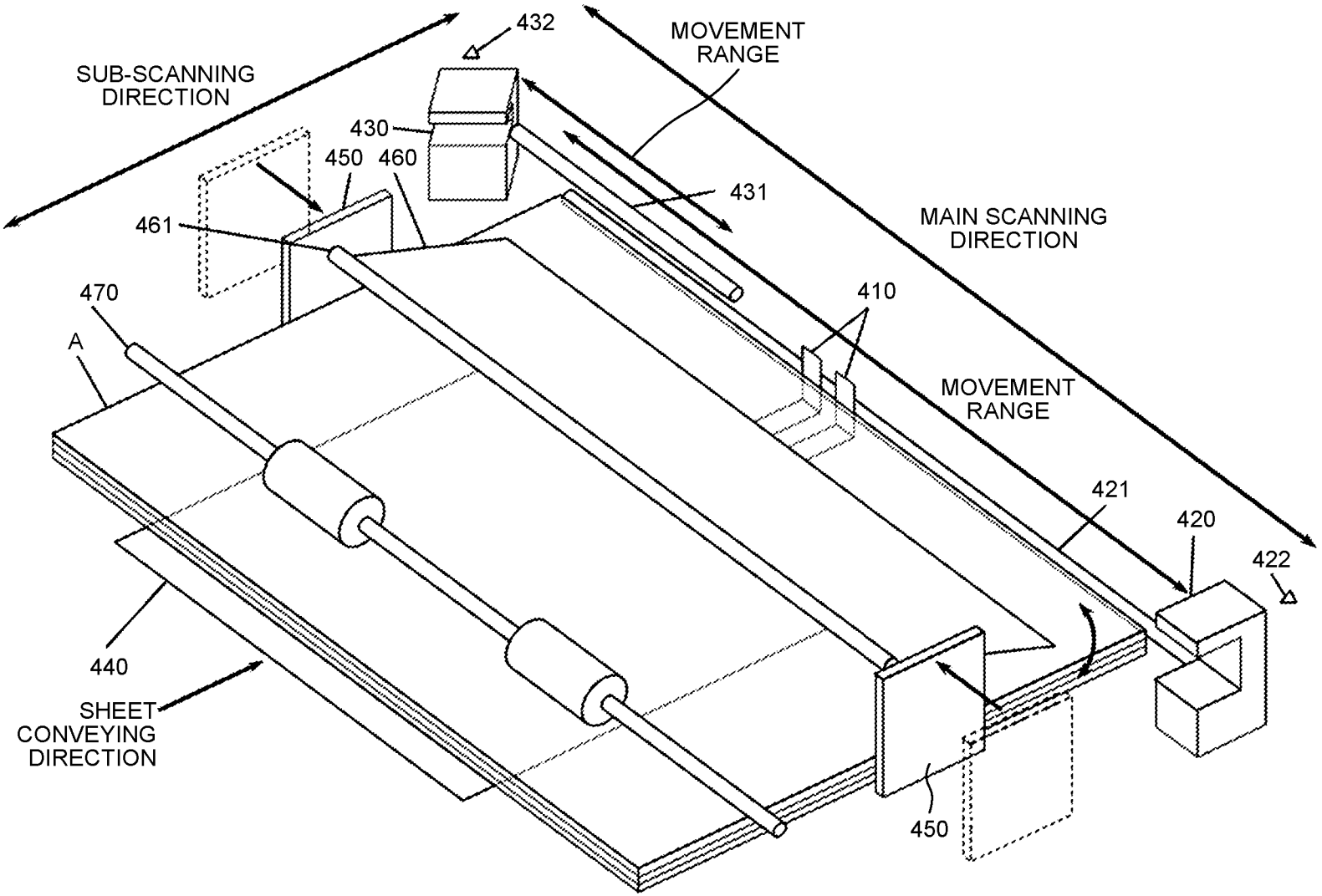
FIG. 16 is a perspective view that illustrates the inside of the stitching processing apparatus according to the embodiment of the present invention.

The sheet stack plate 440 has the bundle of sheets stacked thereon until all the sheets, which are the targets for a stitching operation, are set. As illustrated in FIG. 16, the jogger fences 450 are moved in directions such that they are faced to each other on the edges in a sheet width direction of the sheet bundle A, stacked on the sheet stack plate 440, while they are pressed against the edges in the sheet width direction of the sheet bundle A, whereby the edges of the sheet bundle A in the sheet width direction are aligned.

The conveyance roller 470 further conveys the sheet, conveyed to the sheet stack plate 440, to the downstream side in the sheet conveying direction so as to cause the edge of the sheet with regard to the sheet conveying direction to come into contact with the trailing-edge alignment stopper 410. Furthermore, the conveyance roller 470 discharges the sheet bundle A to the discharge tray 6*b* after the stitching operation. That is, according to the present embodiment, the conveyance roller 470 serves as a conveying unit.

The movable guide plate 460 includes a movable guide-plate rotation fulcrum 461, and it is rotated and moved at the movable guide-plate rotation fulcrum 461 as a rotation fulcrum. Here, the movable guide plate 460 is rotated and moved such that a height P in a thickness direction of the sheet bundle A is changed in accordance with the number of sheets that may be stitched, i.e., it is changed in a case where the sheet bundle A is stitched by the staple-containing stitching unit 420 and a case where it is stitched by the staple-free stitching unit 430.

Figure 17:
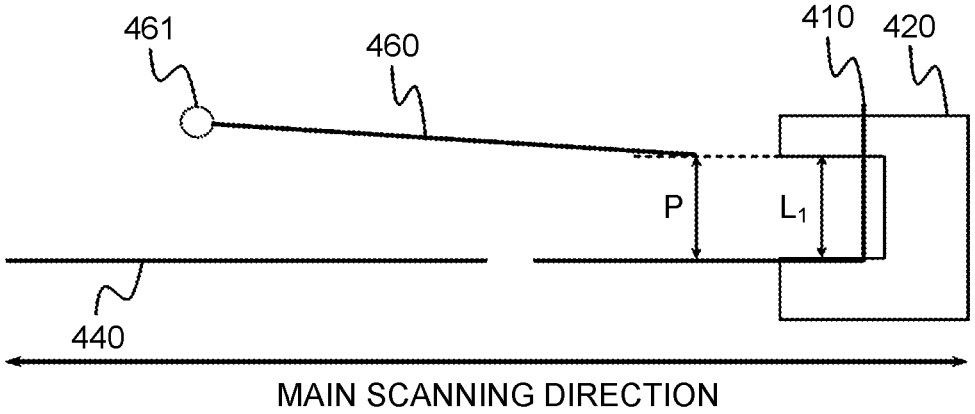
FIG. 17 is a side view that illustrates the inside of the stitching processing apparatus in a main scanning direction according to the embodiment of the present invention.

Specifically, as illustrated in FIG. 17, when the staple-containing stitching unit 420 stitches the sheet bundle A, the stitching processing apparatus 4 according to the present embodiment rotates and moves the movable guide plate 460 such that the above-described height P becomes equal to or more than a receiving width $L_1$ of the stitching recess of the staple-containing stitching unit 420.

Figure 18:
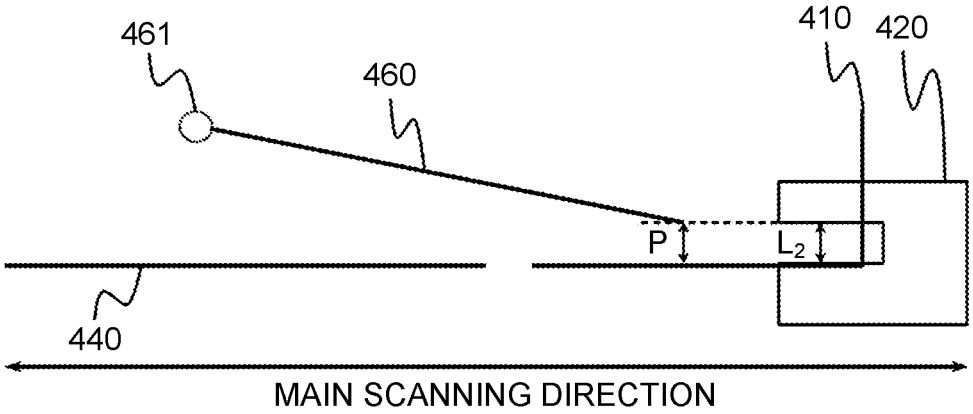
FIG. 18 is a side view that illustrates the inside of the stitching processing apparatus in a main scanning direction according to the embodiment of the present invention.

Conversely, as illustrated in FIG. 18, when the staple-free stitching unit 430 stitches the sheet bundle A, the stitching processing apparatus 4 according to the present embodiment rotates and moves the movable guide plate 460 such that the above-described height P becomes the same as a receiving width $L_2$ of the stitching recess of the staple-free stitching unit 430.

Here, an explanation is given of the reason why the stitching processing apparatus 4 according to the present embodiment rotates and moves the movable guide plate 460 such that the above-described height P is changed in accordance with the number of sheets that may be stitched, i.e., it is changed in a case where the sheet bundle A is stitched by the staple-containing stitching unit 420 and a case where it is stitched by the staple-free stitching unit 430.

Figure 19:
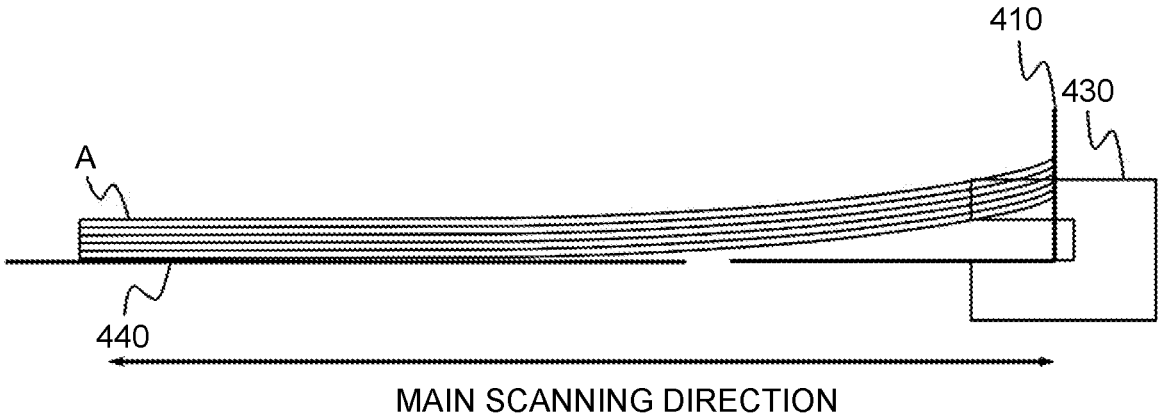
FIG. 19 is a side view that illustrates the inside of the stitching processing apparatus in a main scanning direction according to the embodiment of the present invention.

Sometimes, the sheet bundle A, stacked on the sheet stack plate 440, is curled, bent, or the like. Therefore, if the stitching processing apparatus 4 is not provided with the movable guide plate 460, the thickness of the sheet bundle A sometimes becomes more than the receiving width of the stitching recess of the staple-containing stitching unit 420 or the staple-free stitching unit 430, as illustrated in FIG. 19. In such a case, in the stitching processing apparatus 4, it is difficult to receive the sheet bundle A at the stitching recess of the staple-containing stitching unit 420 or the staple-free stitching unit 430.

Therefore, the stitching processing apparatus 4 according to the present embodiment is configured to rotate and move the movable guide plate 460 such that the height P in a sheet thickness direction is changed in accordance with the number of sheets that may be stitched, i.e., it is changed in a case where the sheet bundle A is stitched by the staple-containing stitching unit 420 and a case where it is stitched by the staple-free stitching unit 430.

Figure 20:
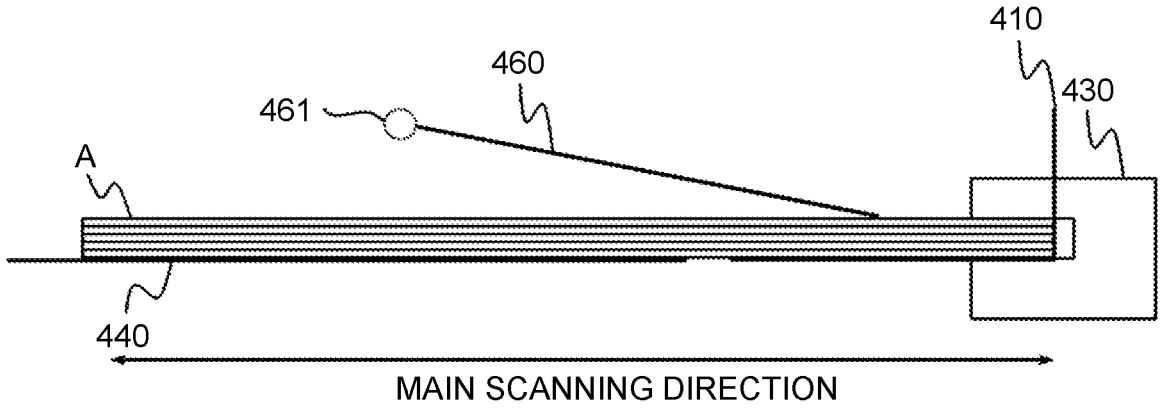
FIG. 20 is a side view that illustrates the inside of the stitching processing apparatus in a main scanning direction according to the embodiment of the present invention.

Therefore, in the stitching processing apparatus 4 according to the present embodiment, even if the sheet bundle A is curled, bent, or the like, the thickness of the sheet bundle A does not become more than the receiving width of the stitching recess of the staple-containing stitching unit 420 or the staple-free stitching unit 430. As a result, in the stitching processing apparatus 4 according to the present embodiment, even if the sheet bundle A is curled, bent, or the like, it is possible to receive the sheet bundle A at the stitching recess of the staple-containing stitching unit 420 or the staple-free stitching unit 430, as illustrated in FIG. 20.

Figure 21:
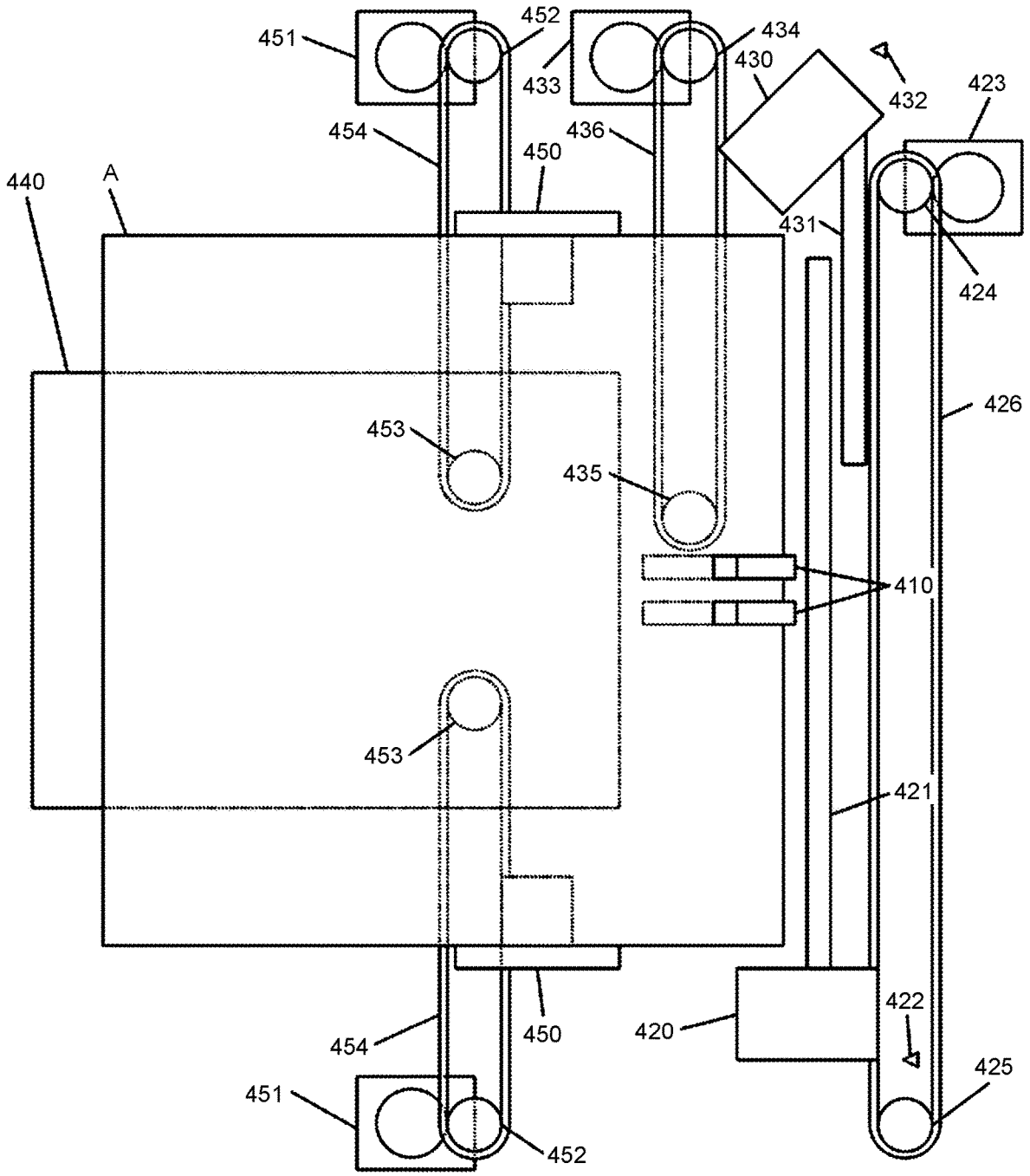
FIG. 21 is a top view that illustrates the inside of the stitching processing apparatus according to the embodiment of the present invention.
Figure 22:
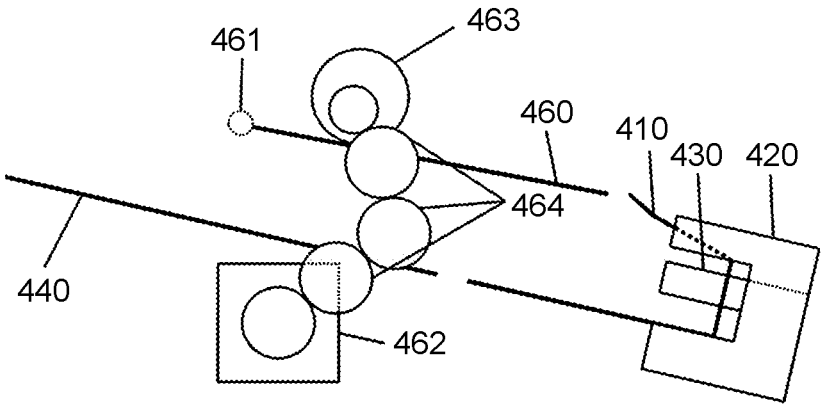
FIG. 22 is a side view that illustrates the inside of the stitching processing apparatus in a main scanning direction according to the embodiment of the present invention.
Figure 22:
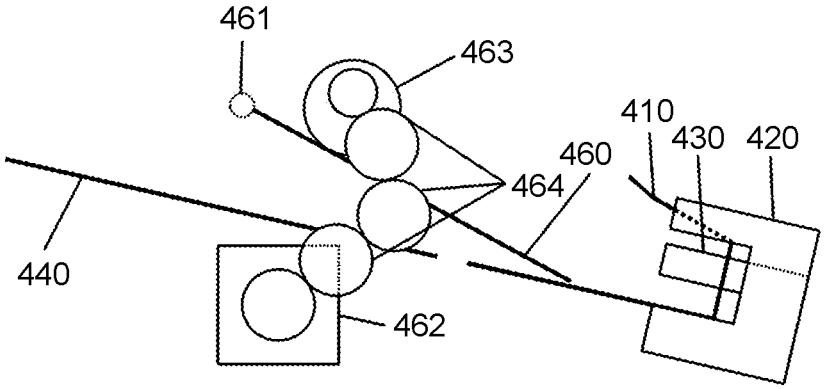

Next, with reference to FIG. 21 and FIGS. 22(*a*) and (*b*), an explanation is given of an operating mechanism of the stitching processing apparatus 4 according to the present embodiment. FIG. 21 is a top view that illustrates the inside of the stitching processing apparatus 4 according to the present embodiment. FIGS. 22(*a*) and (*b*) is a side view that illustrates the inside of the stitching processing apparatus 4 according to the present embodiment in a main scanning direction.

As illustrated in FIG. 21, the staple-containing stitching unit 420 is moved along the staple-containing stitching-unit moving guide rail 421 with the driving force of a staple-containing stitching-unit drive motor 423 via an endless belt 426 that is extended between a drive pulley 424 and a driven pulley 425.

Furthermore, the staple-free stitching unit 430 is moved along a staple-free stitching-unit moving guide rail 431 with the driving force of a staple-free stitching-unit drive motor 433 via an endless belt 436 that is extended between a drive pulley 434 and a driven pulley 435.

Furthermore, the jogger fence 450 is moved in a main scanning direction with the driving force of a jogger-fence drive motor 451 via an endless belt 454 that is extended between a drive pulley 452 and a driven pulley 453.

Furthermore, as illustrated in FIGS. 22(*a*) and (*b*), the movable guide plate 460 is rotated and moved at the movable guide-plate rotation fulcrum 461 as a rotation fulcrum when an eccentric cam 463 is rotated due to the driving force of the movable guide-plate drive motor 462 via a sequence of gears 464.

Figure 23:
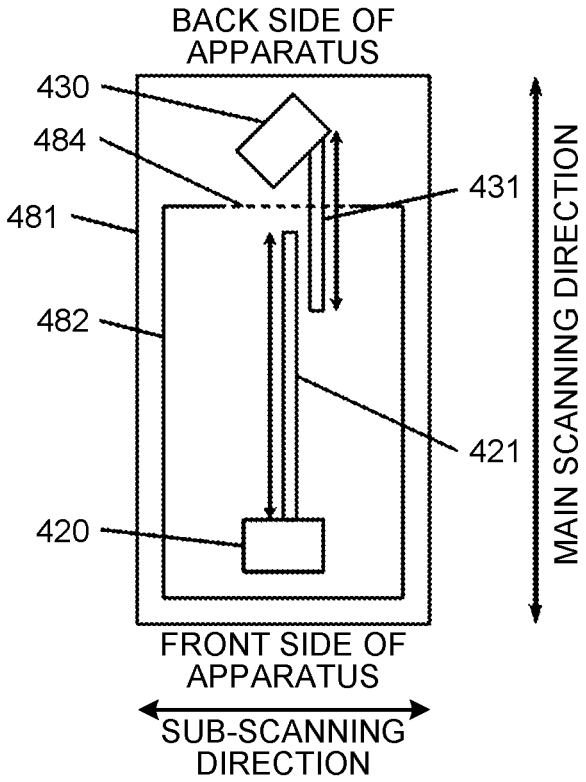
FIG. 23 is a top view that illustrates the peripheral of a staple-containing stitching unit and a staple-free stitching unit in the stitching processing apparatus according to the embodiment of the present invention.
Figure 24:
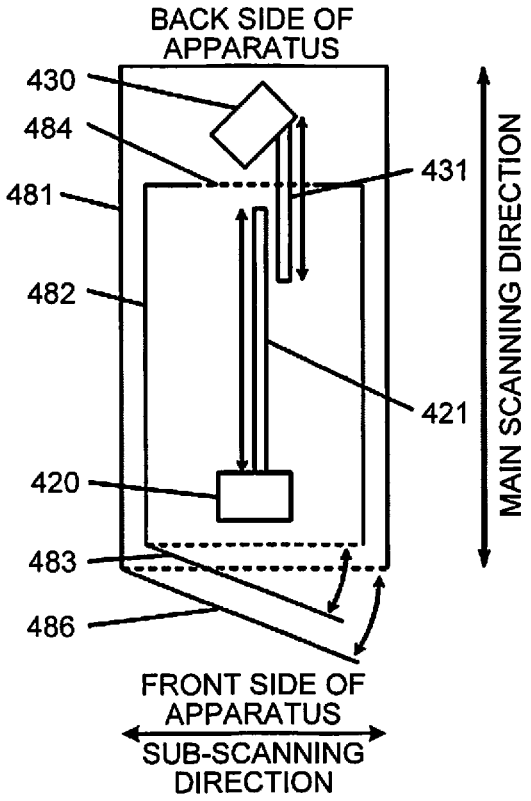
FIG. 24 is a top view that illustrates the peripheral of the staple-containing stitching unit and the staple-free stitching unit in the stitching processing apparatus according to the embodiment of the present invention.
Figure 24:
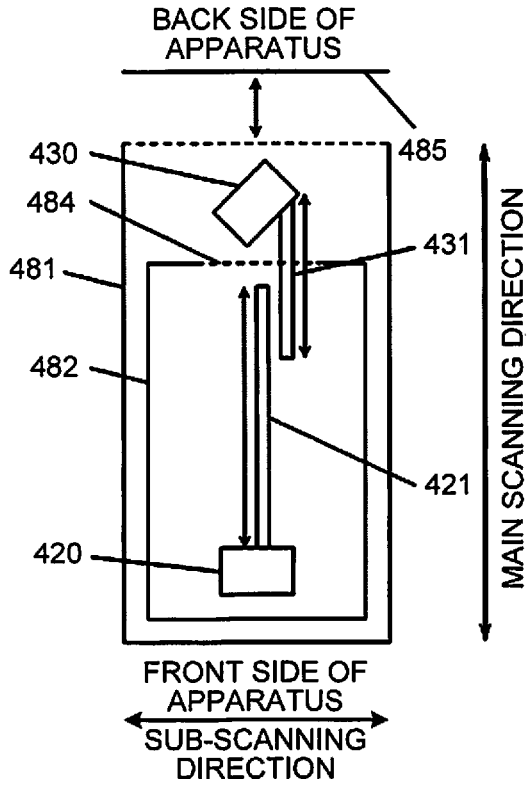

Next, with reference to FIG. 23 and FIGS. 24(*a*) and (*b*), an explanation is given of the arrangement of the staple-containing stitching unit 420 and the staple-free stitching unit 430 in the stitching processing apparatus 4 according to the present embodiment. FIG. 23 and FIGS. 24(*a*) and (*b*) are top views that illustrate the peripheral of the staple-containing stitching unit 420 and the staple-free stitching unit 430 in the stitching processing apparatus 4 according to the present embodiment.

As illustrated in FIG. 23, the stitching processing apparatus 4 according to the present embodiment includes an outer cover 481 and a frame 482. The outer cover 481 covers the entire apparatus. The frame 482 is covered by the outer cover 481, and it supports the sheet conveyance path, which is a path for conveying a sheet, at both ends in a moving direction of the staple-containing stitching unit 420 and the staple-free stitching unit 430. That is, according to the present embodiment, the frame 482 serves as a conveyance-path supporting unit.

Furthermore, as illustrated in FIG. 23, the stitching processing apparatus 4 according to the present embodiment is configured such that, in the inside of the outer cover 481, the staple-containing stitching unit 420 is located on the front side of the apparatus and the staple-free stitching unit 430 is located on the back side of the apparatus.

Furthermore, as illustrated in FIG. 23, in the stitching processing apparatus 4 according to the present embodiment, the staple-containing stitching unit 420 and the staple-free stitching unit 430 are configured to move in a main scanning direction within the frame 482.

Furthermore, as illustrated in FIG. 24(*a*), the stitching processing apparatus 4 according to the present embodiment includes a front-side open/close cover 486, which may be opened and closed at the outer cover 481 on the front side of the apparatus, and a frame open/close cover 483, which is opened and closed at the frame 482 on the front side of the apparatus together with the front-side open/close cover 486. That is, according to the present embodiment, the front-side open/close cover 486 serves as a first cover or a second cover.

As described above, the stitching processing apparatus 4 according to the present embodiment is configured such that the staple-containing stitching unit 420 is located on the front side of the apparatus and the front side of the apparatus may be opened and closed by the front-side open/close cover, whereby it is possible to facilitate an operation to supply staples to the staple-containing stitching unit 420.

Furthermore, the staple-free stitching unit 430 may be located on the back side of the apparatus, as there is no need to supply staples and there is no need to make access during the normal time. However, if the staple-free stitching unit 430 is located on the back side of the apparatus, when the need comes to access the staple-free stitching unit 430 during repair or maintenance of the staple-free stitching unit 430, or the like, there is a problem in that it is difficult for a user to access the staple-free stitching unit.

Therefore, as illustrated in FIG. 24(*b*), the stitching processing apparatus 4 according to the present embodiment includes a hole section 484, through which the staple-free stitching unit 430 may pass, at the frame 482 on the back side of the apparatus. Furthermore, as illustrated in FIG. 24(*b*), in the stitching processing apparatus 4 according to the present embodiment, the staple-free stitching unit 430 is configured to move in a main scanning direction so as to move in and out through the hole section 484 so that it may move in and out of the frame 482.

Furthermore, as illustrated in FIG. 24(*b*), the stitching processing apparatus 4 according to the present embodiment includes a back-side open/close cover 485, which may be opened and closed, at the outer cover 481 on the back side of the apparatus. That is, according to the present embodiment, the back-side open/close cover 485 serves as the first cover or the second cover.

The back-side open/close cover 485 is fixed to the outer cover 481 or the frame 482 with a fixture, such as a screw, in the stitching processing apparatus 4 according to the present embodiment, and it is not opened and closed at the normal time but it is opened and closed only during maintenance or when the staple-free stitching unit 430 has a failure.

As described above, the stitching processing apparatus 4 according to the present embodiment is configured such that the entire staple-free stitching unit 430 may be moved out of the frame 482 on the back side of the apparatus and the back side of the apparatus may be opened and closed by the back-side open/close cover 485.

Thus, in the stitching processing apparatus 4 according to the present embodiment, it is possible to make access to the staple-free stitching unit 430 in an easy manner without disassembling or removing the frame 482 by a user.

Therefore, in the stitching processing apparatus 4 according to the present embodiment, even if the need comes to access the staple-free stitching unit 430 during repair or maintenance of the staple-free stitching unit 430, or the like, it is possible for a user to easily access the staple-free stitching unit 430.

Furthermore, in the present embodiment, an explanation is given of the stitching processing apparatus 4 that is configured to move the staple-free stitching unit 430 so that the entire staple-free stitching unit 430 is located outside of the frame 482 on the back side of the apparatus.

Alternatively, the stitching processing apparatus 4 according to the present embodiment may be configured to move the staple-free stitching unit 430 so that only part of the staple-free stitching unit 430 is located outside of the frame 482. With this configuration of the stitching processing apparatus 4 according to the present embodiment, it is possible to reduce its size.

Furthermore, the stitching processing apparatus 4 according to the present embodiment is configured such that the staple-free stitching unit 430 is moved to the outside of the frame 482 on the back side of the apparatus; however, a configuration may be such that the home position of the staple-free stitching unit 430 is set on the outside of the frame 482. With this configuration of the stitching processing apparatus 4 according to the present embodiment, it is possible to omit the process to move the staple-free stitching unit 430 to the outside of the frame 482 during access to the staple-free stitching unit 430.

Furthermore, in the present embodiment, an explanation is given of the stitching processing apparatus 4, in which the staple-containing stitching unit 420 is located on the front side of the apparatus and the staple-free stitching unit 430 is located on the back side of the apparatus. Alternatively, with the stitching processing apparatus 4 according to the present embodiment, there may be a case where the staple-containing stitching unit 420 is located on the back side of the apparatus and the staple-free stitching unit 430 is located on the front side of the apparatus. With this configuration of the stitching processing apparatus 4 according to the present embodiment, it is possible to facilitate access to the staple-free stitching unit 430.

Furthermore, in the present embodiment, an explanation is given of the stitching processing apparatus 4 that is configured such that the staple-free stitching unit 430 may be moved to the outside of the frame 482 on the back side of the apparatus. Alternatively, the stitching processing apparatus 4 according to the present embodiment may be configured such that the staple-containing stitching unit 420 is movable to the outside of the frame 482 on the front side of the apparatus. With this configuration of the stitching processing apparatus 4 according to the present embodiment, it is possible to facilitate an operation to supply staples to the staple-containing stitching unit 420.

Second Embodiment

Figure 25:
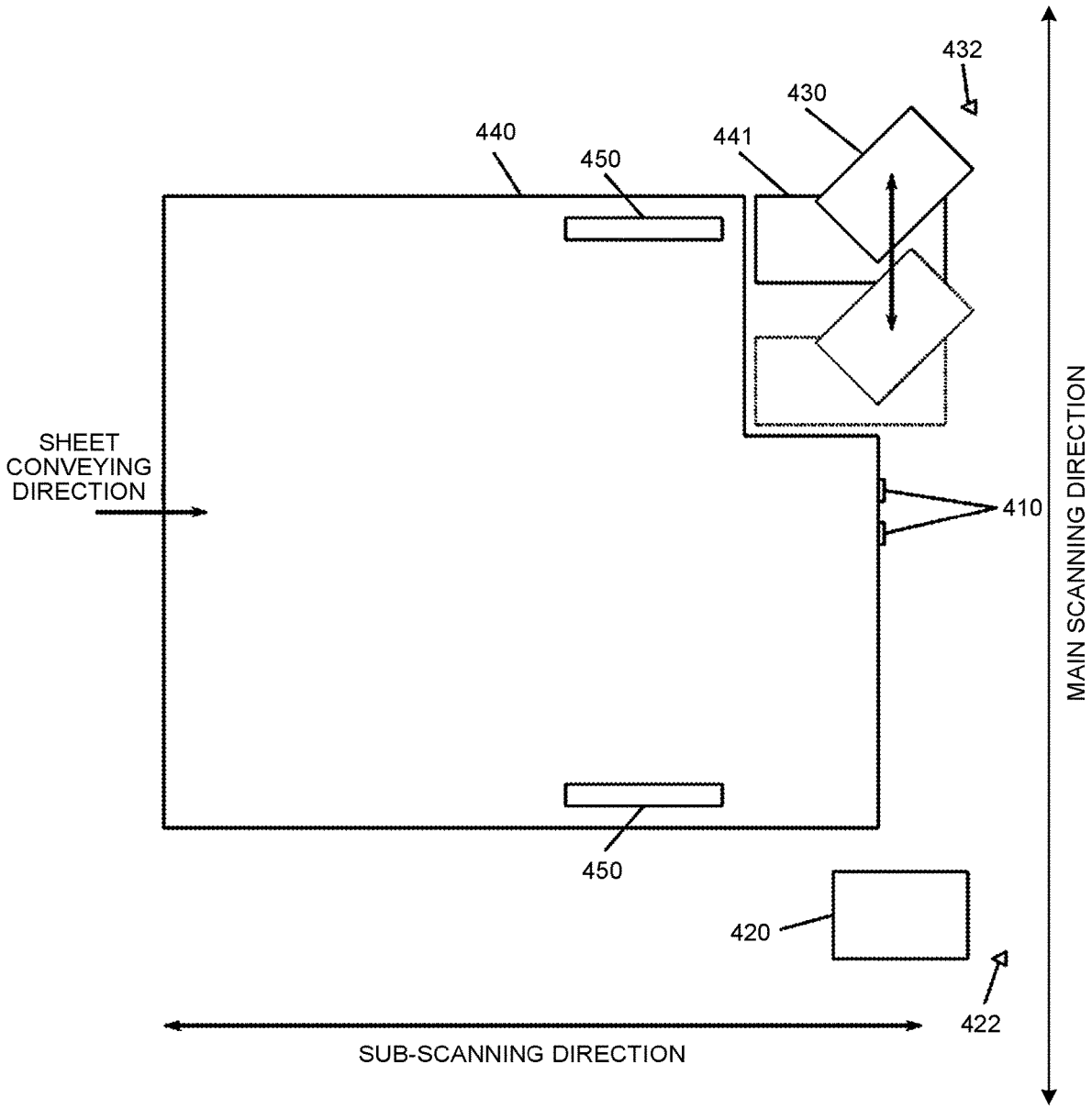
FIG. 25 is a top view that illustrates the inside of the stitching processing apparatus according to the embodiment of the present invention.

With reference to the drawings, a detailed explanation is given below of an embodiment of the present invention. Furthermore, the component, attached with the same reference numeral as that in the first embodiment, indicates the same or equivalent unit, and detailed explanations are omitted. First, with reference to FIG. 25, an explanation is given of the configuration of the stitching processing apparatus 4 according to the present embodiment. FIG. 25 is a top view that illustrates the inside of the stitching processing apparatus 4 according to the present embodiment.

As is the case with the first embodiment, the stitching processing apparatus 4 according to the present embodiment is configured such that the staple-containing stitching unit 420 is located on the front side of the apparatus and the staple-free stitching unit 430 is located on the back side of the apparatus.

Furthermore, the stitching processing apparatus 4 according to the present embodiment is configured such that sheets are conveyed with reference to the front side of the apparatus or with reference to the center of the apparatus. This is because, if sheets are conveyed with reference to the back of the apparatus and if a sheet is jammed, an operation to remove the jammed sheet is associated with difficulty. Particularly, if a small-sized sheet is jammed, the removing operation becomes further difficult.

Therefore, in the stitching processing apparatus 4 according to the present embodiment, the staple-free stitching unit 430, located on the back side of the apparatus, needs to move in a main scanning direction so as to handle an operation to stitch both minimum-sized sheets and maximum-sized sheets.

Furthermore, in the stitching processing apparatus 4 according to the present embodiment, the staple-free stitching unit 430 is configured to conduct staple-free stitching while it is tilted relative to a sheet, e.g., while it is tilted at 45 degrees, so as to increase the stitching force.

Furthermore, the stitching processing apparatus 4 according to the present embodiment is configured such that the width of the sheet stack plate 440 in a main scanning direction is smaller than the width of a maximum-sized sheet in a main scanning direction and is larger than the width of a minimum-sized sheet in a main scanning direction.

Therefore, in the staple-free stitching unit 430, when a minimum-sized sheet is stitched, the back side of the stitching recess sometimes hits the corner of the sheet stack plate 440 while it is moved from the home position to the stitching position.

Therefore, in order to prevent the above-described hit, it is considered to have a configuration such that the depth of the stitching recess of the staple-free stitching unit 430 is made longer. However, the staple-free stitching unit 430 needs to conduct pressure bonding on sheets with an extremely large force, e.g., 200 N; therefore, it is necessary to have a configuration such that the distance between the fulcrum and the point of action, i.e., the depth of the stitching recess is short as much as possible.

Therefore, as illustrated in FIG. 25, in the stitching processing apparatus 4 according to the present embodiment, the sheet stack plate 440 is configured to have a cutout in the range within which the staple-free stitching unit 430 moves. Thus, even when a minimum-sized sheet is stitched, the staple-free stitching unit 430 may be moved to the stitching position while the back side of the stitching recess is prevented from hitting the corner of the sheet stack plate 440 when it is moved from the home position to the stitching position.

Figure 26:
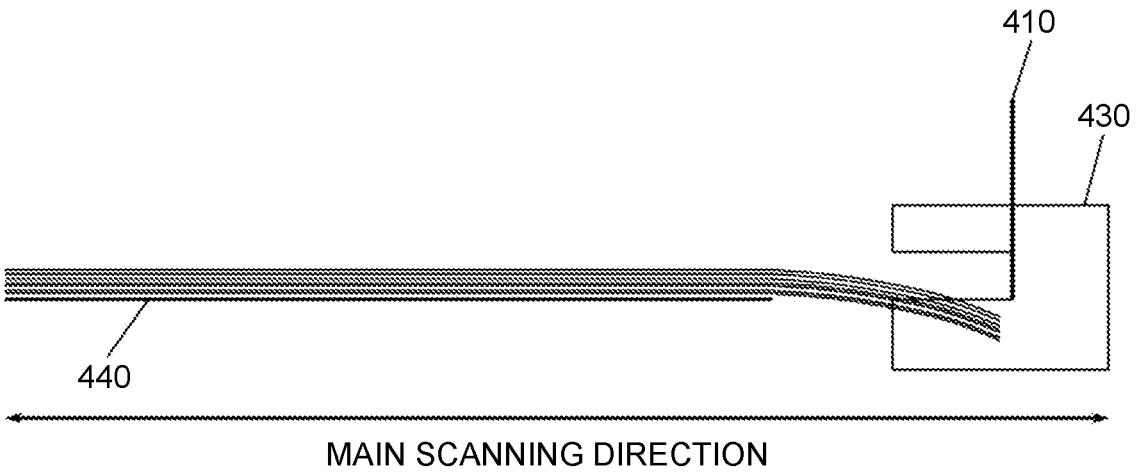
FIG. 26 is a side view that illustrates the inside of the stitching processing apparatus in a main scanning direction according to the embodiment of the present invention.

However, if the sheet stack plate 440 is configured as described above, the sheet bundle A sometimes hangs down at the cutout section of the sheet stack plate 440, as illustrated in FIG. 26.

Then, if the stitching processing apparatus 4 moves the staple-free stitching unit 430 from the home position to the stitching position in the above state, the stitching recess of the staple-free stitching unit 430 hits the end of the sheet bundle A with regard to the main scanning direction. Therefore, in such a case, it is difficult for the stitching processing apparatus 4 to perform a stitching operation properly by using the staple-free stitching unit 430.

Therefore, as illustrated in FIG. 25, the stitching processing apparatus 4 according to the present embodiment is configured to include a movable sheet supporting plate 441 that moves together with the staple-free stitching unit 430 and supports the sheet bundle A in a stitching direction so as to prevent the sheet bundle A from handing down at the cutout section of the sheet stack plate 440. That is, according to the present embodiment, the movable sheet supporting plate 441 serves as a sheet supporting unit.

Figure 27:
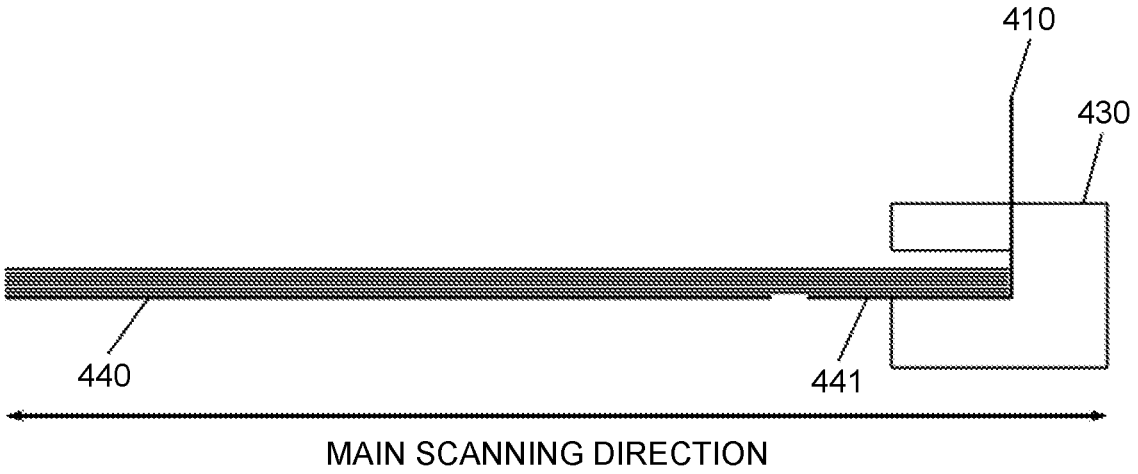
FIG. 27 is a side view that illustrates the inside of the stitching processing apparatus in a main scanning direction according to the embodiment of the present invention.

With this configuration of the stitching processing apparatus 4 according to the present embodiment, it is possible to receive the sheet bundle A at the stitching recess of the staple-free stitching unit 430 without making a hit between the back side of the stitching recess of the staple-free stitching unit 430 and the corner of the sheet stack plate 440, as illustrated in FIG. 27.

Figure 28:
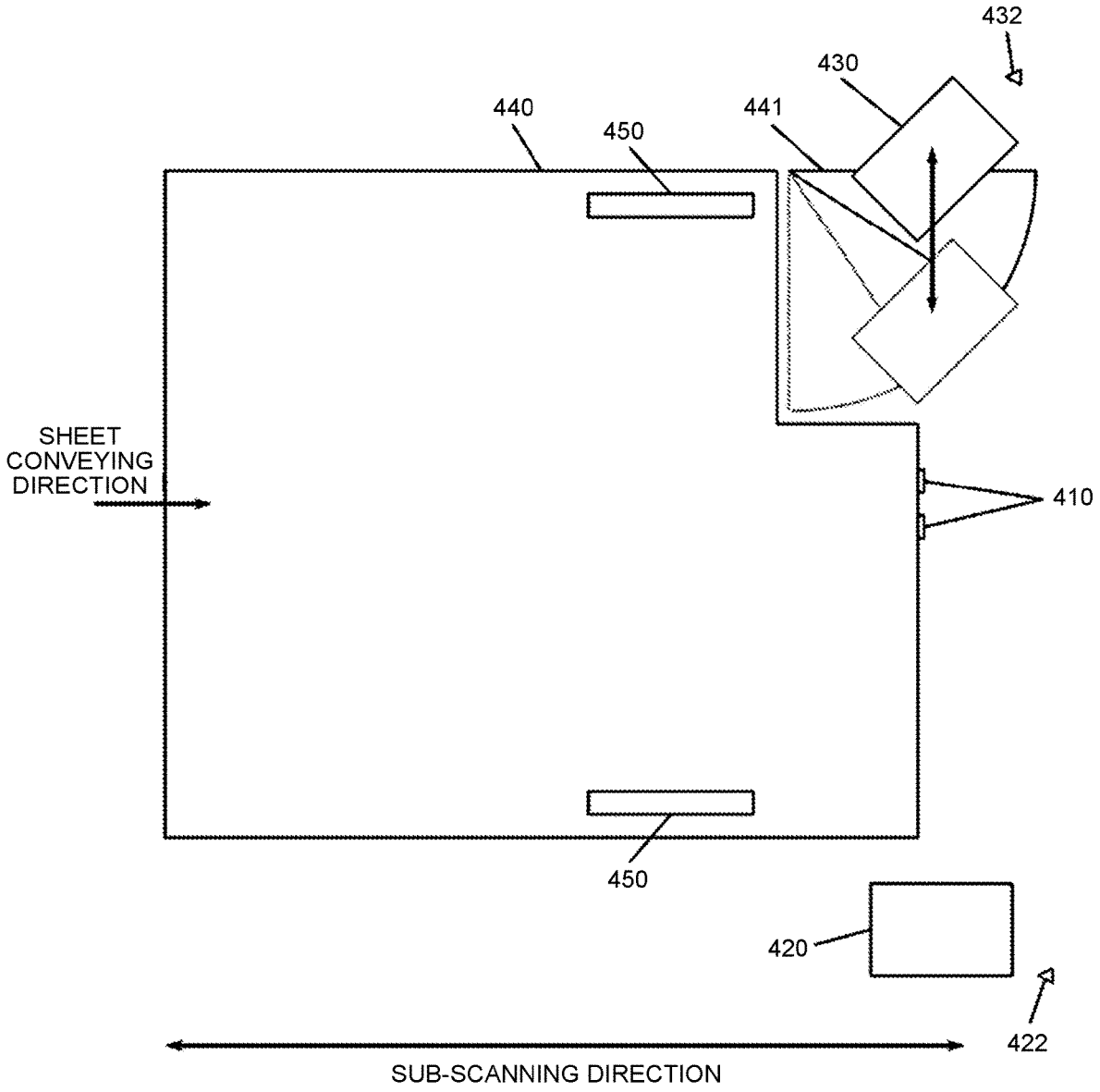
FIG. 28 is a top view that illustrates the inside of the stitching processing apparatus according to the embodiment of the present invention.

Furthermore, in the present embodiment, an explanation is given of the stitching processing apparatus 4 that is configured such that the movable sheet supporting plate 441 is fixed to the staple-free stitching unit 430. Alternatively, as illustrated in FIG. 28, the stitching processing apparatus 4 according to the present embodiment may be configured such that the movable sheet supporting plate 441 and the staple-free stitching unit 430 are individually moved although they are moved in conjunction with each other.

Furthermore, alternatively, the stitching processing apparatus 4 according to the present embodiment may be configured to include a drive unit that drives the movable sheet supporting plate 441 so that the movable sheet supporting plate 441 and the staple-free stitching unit 430 are individually moved although they are moved in conjunction with each other.

Furthermore, in the present embodiment, an explanation is given of the stitching processing apparatus 4, in which the staple-containing stitching unit 420 is located on the front side of the apparatus and the staple-free stitching unit 430 is located on the back side of the apparatus. Alternatively, with the stitching processing apparatus 4 according to the present embodiment, there may be a case where the staple-containing stitching unit 420 is located on the back side of the apparatus and the staple-free stitching unit 430 is located on the front side of the apparatus.

According to the present invention, in a sheet processing apparatus that includes multiple stitching units, it is possible to facilitate user's access to the stitching units.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming system comprising:

an image forming apparatus configured to form an image on a sheet; and a sheet processing apparatus configured to stitch a bundle of sheets, on which an image is formed by the image forming apparatus, the sheet processing apparatus including a sheet stacker configured to stack thereon multiple sheets;

a staple-containing stitching unit configured to stitch the sheets using one or more staples;

a staple-free stitching unit configured to stitch the sheets without using a staple;

a first drive source configured to drive the staple-containing stitching unit;

a second drive source separate from the first drive source and configured to drive the staple-free stitching unit;

a frame including at least a first frame member and a second frame member respectively disposed outside both ends of the sheet stacker in a direction perpendicular to a sheet conveying direction in which the sheets enter the sheet stacker, the first frame member being disposed on a side where the staple-containing stitching unit is disposed, the second frame member being disposed on a side where the staple-free stitching unit is disposed, and the second frame member including a hole section; and an outer cover including at least a first cover member and a second cover member respectively disposed further outside the first and second frame members in the direction perpendicular to the sheet conveying direction, wherein the staple-free stitching unit is disposed on a back side of the sheet processing apparatus, and the staple-containing stitching unit is disposed on a front side of the sheet processing apparatus, at least a part of the first cover member is openable and closable, and at least a part of the second cover member is detachable, and the staple-free stitching unit located between the second frame and the second cover member when the staple-free stitching unit stands by at a home position.

2. The image forming system according to claim 1, wherein a whole of the staple-free stitching unit is movable to a position located between the second frame member and the second cover member in the direction perpendicular to the sheet conveying direction.

3. The image forming system according to claim 1, wherein a part of the staple-free stitching unit is movable to a position located between the second frame member and the second cover member in the direction perpendicular to the sheet conveying direction.

4. The image forming system according to claim 1, wherein at least a stitching member, which stitches a sheet bundle, of the staple-free stitching unit is located between the second frame member and the second cover member in the direction perpendicular to the sheet conveying direction.

5. The image forming system according to claim 1, wherein a moving range of the staple-containing stitching unit and a moving range of the staple-free stitching unit at least partially overlap in the sheet conveying direction.

6. The image forming system according to claim 1, further comprising a movable guide member that is movable in a thickness direction of the sheets, the movable guide member being disposed above the sheets.

7. The image forming system according to claim 6, wherein when the movable guide member is positioned at the lowermost position, a gap between the tip of the movable guide member and the sheet stacker is equal to or smaller than a height of a stitching opening of the staple-free stitching unit.

8. The image forming system according to claim 1, further comprising:

a first guide member configured to guide the staple-containing stitching unit such that the staple-containing stitching unit moves in the direction perpendicular to the sheet conveying direction; and a second guide member configured to guide the staple-free stitching unit such that the staple-free stitching unit moves in the direction perpendicular to the sheet conveying direction.

9. The image forming system according to claim 1, wherein at a time of maintenance, repair, or failure of the staple-free stitching unit, the staple-free stitching unit is movable from a position located within the frame to a position located outside the frame between the second frame member and the second cover member through the hole section of the second frame member.

* * * * *